US011186787B2

(12) United States Patent
Pathare et al.

(10) Patent No.: US 11,186,787 B2
(45) Date of Patent: Nov. 30, 2021

(54) BASE STOCKS AND LUBRICANT COMPOSITIONS CONTAINING SAME

(71) Applicant: ExxonMobil Research and Engineering Company, Annandale, NJ (US)

(72) Inventors: Rugved P. Pathare, Sarnia (CA); Lisa I-Ching Yeh, Marlton, NJ (US); Yogi V. Shukla, Cherry Hill, NJ (US); Charles L. Baker, Jr., Thornton, PA (US); Bryan E. Hagee, Hamilton, NJ (US); Debra A. Sysyn, Monroe, NJ (US); Kendall S. Fruchey, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/527,861

(22) Filed: Jul. 31, 2019

(65) Prior Publication Data

US 2019/0375997 A1 Dec. 12, 2019

Related U.S. Application Data

(62) Division of application No. 15/468,380, filed on Mar. 24, 2017, now Pat. No. 10,414,995.
(Continued)

(51) Int. Cl.
*C10G 65/12* (2006.01)
*C10G 47/18* (2006.01)
(Continued)

(52) U.S. Cl.
CPC ..... *C10G 65/12* (2013.01); *C10G 47/18* (2013.01); *C10G 69/02* (2013.01);
(Continued)

(58) Field of Classification Search
CPC ..... C10M 101/02; C10M 2203/1025; C10M 2203/1045; C10M 2203/1065;
(Continued)

(56) References Cited

U.S. PATENT DOCUMENTS 3,354,078 A 11/1967 Miale et al.
5,332,566 A 7/1994 Moini
(Continued)

FOREIGN PATENT DOCUMENTS

WO 00/40333 A1 7/2000
WO 2004/007646 A1 1/2004
(Continued)

OTHER PUBLICATIONS

The International Search Report and Written Opinion of PCT/US2017/024236 dated Jul. 7, 2017.
(Continued)

*Primary Examiner* — James C Goloboy
(74) *Attorney, Agent, or Firm* — Scott F. Yarnell

(57) ABSTRACT

A base stock having at least 90 wt. % saturates, an amount and distribution of aromatics, as determined by ultra violet (UV) spectroscopy, including an absorptivity between 280 and 320 nm of less than 0.015 l/gm-cm, a viscosity index (VI) from 80 to 120, and having a cycloparaffin performance ratio greater than 1.05 and a kinematic viscosity at 100° C. between 4 and 6 cSt. A base stock having at least 90 wt. % saturates, an amount and distribution of aromatics, as determined by UV spectroscopy, including an absorptivity between 280 and 320 nm of less than 0.020 l/gm-cm, a viscosity index (VI) from 80 to 120, and having a cycloparaffin performance ratio greater than 1.05 and a kinematic viscosity at 100° C. between 10 and 14 cSt. A lubricating oil having the base stock as a major component, and one or more additives as a minor component. Methods for improv-
(Continued)

ing oxidation performance and low temperature performance of formulated lubricant compositions through the compositionally advantaged base stock.

42 Claims, 16 Drawing Sheets

Related U.S. Application Data

(60) Provisional application No. 62/315,808, filed on Mar. 31, 2016, provisional application No. 62/356,749, filed on Jun. 30, 2016.

(51) Int. Cl.

| | |
|---|---|
| ***C10M 101/02*** | (2006.01) |
| ***C10G 69/02*** | (2006.01) |
| ***C10N 20/00*** | (2006.01) |
| ***C10N 20/02*** | (2006.01) |
| ***C10N 30/02*** | (2006.01) |
| ***C10N 30/08*** | (2006.01) |
| ***C10N 30/10*** | (2006.01) |
| ***C10N 40/12*** | (2006.01) |
| ***C10N 40/25*** | (2006.01) |

(52) U.S. Cl.
CPC ..... *C10M 101/02* (2013.01); *C10G 2300/202* (2013.01); *C10G 2300/302* (2013.01); *C10G 2400/10* (2013.01); *C10M 2203/1006* (2013.01); *C10M 2203/1025* (2013.01); *C10M 2203/1045* (2013.01); *C10M 2203/1065* (2013.01); *C10N 2020/01* (2020.05); *C10N 2020/02* (2013.01); *C10N 2020/065* (2020.05); *C10N 2030/02* (2013.01); *C10N 2030/08* (2013.01); *C10N 2030/10* (2013.01); *C10N 2040/12* (2013.01); *C10N 2040/25* (2013.01)

(58) Field of Classification Search
CPC ..... C10N 2020/02; C10N 2020/022; C10N 2020/025; C10N 2030/08; C10N 2030/10; C10G 2300/202; C10G 2300/302; C10G 2400/10
See application file for complete search history.

(56) References Cited

U.S. PATENT DOCUMENTS

| | | | |
|---|---|---|---|
| 6,156,695 | A | 12/2000 | Soled et al. |
| 6,162,350 | A | 12/2000 | Soled et al. |
| 6,299,760 | B1 | 10/2001 | Soled et al. |
| 6,569,312 | B1 | 5/2003 | Carroll et al. |
| 6,582,590 | B1 | 6/2003 | Riley et al. |
| 6,712,955 | B1 | 3/2004 | Hou et al. |
| 6,783,663 | B1 | 8/2004 | Riley et al. |
| 6,863,803 | B1 | 3/2005 | Riley et al. |
| 6,929,738 | B1 | 8/2005 | Riley et al. |
| 7,229,548 | B2 | 6/2007 | Riley et al. |
| 7,288,182 | B1 | 10/2007 | Soled et al. |
| 7,410,924 | B2 | 8/2008 | Corma Canos et al. |
| 7,544,632 | B2 | 6/2009 | Soled et al. |
| 7,704,930 | B2 | 4/2010 | Deckman et al. |
| 8,114,678 | B2 | 2/2012 | Chawla et al. |
| 8,778,171 | B2 | 7/2014 | Oliveri et al. |
| 8,932,454 | B2 | 1/2015 | Wu et al. |
| 8,992,764 | B2 | 3/2015 | Prentice et al. |
| 2004/0092384 | A1 | 5/2004 | Timken et al. |
| 2005/0277545 | A1 | 12/2005 | Shih et al. |
| 2006/0027486 | A1 | 2/2006 | Rosenbaum et al. |
| 2006/0060502 | A1 | 3/2006 | Soled et al. |
| 2007/0084754 | A1 | 4/2007 | Soled et al. |
| 2008/0132407 | A1 | 6/2008 | Bai et al. |
| 2009/0143261 | A1 | 6/2009 | Takeoka et al. |
| 2010/0070202 | A1 | 3/2010 | Gould et al. |
| 2011/0315596 | A1 | 12/2011 | Prentice et al. |
| 2013/0264246 | A1* | 10/2013 | Holtzer ..... C10G 69/02 208/19 |
| 2013/0341243 | A1 | 12/2013 | Novak et al. |
| 2016/0168333 | A1* | 6/2016 | Podsiadlo ..... B01J 20/28064 208/310 R |
| 2017/0137726 | A1* | 5/2017 | Ho ..... C10G 57/00 |

FOREIGN PATENT DOCUMENTS

| | | | |
|---|---|---|---|
| WO | 2007/084437 | A2 | 7/2007 |
| WO | 2007/084438 | A2 | 7/2007 |
| WO | 2007/084439 | A1 | 7/2007 |
| WO | 2007/084471 | A1 | 7/2007 |
| WO | 2017172572 | A1 | 10/2017 |

OTHER PUBLICATIONS

The International Search Report and Written Opinion of PCT/US2017/024242 dated Jun. 30, 2017.

Miale, J.N. et al., "Catalysis by Crystalline Aluminosilicates IV. Attainable Catalytic Cracking Rate Constants, and Superactivity", Journal of Catalysis, 1966, vol. 6, pp. 278-287.

Cramer, D.C. et al., "Influence of Group II & III Base Oil Composition on VI and Oxidation Stability", 1999, AIChE Spring National Meeting, Houston, Texas.

Johnson, Marvin F. L., "Estimation of the Zeolite Content of a Catalyst from Nitrogen Adsorption Isotherms", Journal of Catalysis, 1978, vol. 52, pp. 425-431.

Olson, D.H. et al., "Chemical and Physical Properties of the ZSM-5 Substitutional Series", Journal of Catalysis, 1980, vol. 61, pp. 390-396.

Weisz, P.B. et al., "Superactive Crystalline Aluminosilicate Hydrocarbon Catalysts", Journal of Catalysis, 1965, vol. 4, pp. 527-529.

Gatto, V.J. et al., "The Influence of Chemical Structure on the Physical Properties and Antioxidant Response of Hydrocracked Base Stocks and Polyalphaolefins", Journal of Synthetic Lubrication, 2002, vol. 19, issue 4, pp. 3-18.

* cited by examiner

| X-Class | 2 | 0 | -2 | -4 | -6 | -8 | -10 |
|---|---|---|---|---|---|---|---|
| Predominant species | Iso-Paraffins of formula $C_nH_{2n+2}$ | 1 ring cycloparaffins of formula $C_nH_{2n}$ | 2 ring cycloparaffins of formula $C_nH_{2n-2}$ | 3 ring cycloparaffins of formula $C_nH_{2n-4}$ | 4 ring cycloparaffins of formula $C_nH_{2n-6}$ | 5 ring cycloparaffins of formula $C_nH_{2n-8}$ | 6 ring cycloparaffins of formula $C_nH_{2n-10}$ |
| Example Ring structures | N/A | | | | | | |
| Minor species (may or may not be present) | Species with Naphthenoaromatic ring structures of formula $C_nH_{2n+Z}$ where Z= -2(Number of rings+ number of double bonds - 1) | | | | | | |
| Example Ring structures | | | | | | | |

Fig. 8

| | | | | Examples of inventive base stocks | | | | Ref LN A | Ref LN B | Ref LN C | Ref LN D | Comparative LN E | Comparative LN F | Comparative LN G |
|---|---|---|---|---|---|---|---|---|---|---|---|---|---|---|
| 1 | Kinematic Viscosity at 100 C | ASTM D445 | cSt | 5.38 | 5.40 | 5.05 | 5.26 | 5.24 | 5.35 | 5.35 | 5.38 | 5.28 | 5.32 | 5.34 |
| 2 | Kinematic Viscosity at 40 C | ASTM D445 | Cst | 30.51 | 30.69 | 27.41 | 29.23 | 28.63 | 29.21 | 29.63 | 30.17 | 30.55 | 30.11 | 30.68 |
| 3 | Viscosity Index | | | 110.5 | 110.4 | 111.4 | 112.2 | 115.0 | 117.5 | 114.5 | 113.1 | 104.1 | 109.3 | 107.2 |
| 4 | Total Cycloparaffins | SFC | % | 77.8 | 78.2 | 77.8 | 77.7 | 74.2 | 77.1 | 78.5 | 79.6 | 79.0 | 77.1 | 80.9 |
| 5 | Sats X 0 (1 Ring CP) | GCMS | % | 48.4 | 47.5 | 45.5 | 44.9 | 38.5 | 40.6 | 40.6 | 40.5 | 38.0 | 37.1 | 40.2 |
| 6 | Sats X -2 (2 Ring CP) | GCMS | % | 21.2 | 21.8 | 24.1 | 24.2 | 24.7 | 25.4 | 26.5 | 27.4 | 26.9 | 27.4 | 27.7 |
| 7 | Sats X -4 (3 Ring CP) | GCMS | % | 4.7 | 5.2 | 5.7 | 5.9 | 7.8 | 8.1 | 8.4 | 8.8 | 10.0 | 9.2 | 9.4 |
| 8 | Sats X -6 (4 Ring CP) | GCMS | % | 1.5 | 1.6 | 1.4 | 1.4 | 2.1 | 2.0 | 2.1 | 2.1 | 2.8 | 2.2 | 2.4 |
| 9 | Sats X -8 (5 Ring CP) | GCMS | % | 1.3 | 1.3 | 0.8 | 0.8 | 0.8 | 0.7 | 0.8 | 0.7 | 1.1 | 0.9 | 1.0 |
| 10 | Sats X -10 (6 Ring CP) | GCMS | % | 0.8 | 0.8 | 0.4 | 0.4 | 0.4 | 0.3 | 0.2 | 0.2 | 0.3 | 0.2 | 0.3 |
| 11 | Sats X 2 (iso-paraffins) | GCMS | % | 22.2 | 21.8 | 22.2 | 22.3 | 25.8 | 22.9 | 21.5 | 20.4 | 21.0 | 22.9 | 19.1 |
| 12 | MM-Paraffins | GCMS | % | 1.2 | 1.3 | 1.2 | 0.6 | 1.8 | 1.5 | 1.4 | 1.2 | 1.9 | 1.6 | 1.6 |
| 13 | DM-Paraffins | GCMS | % | 21.0 | 20.5 | 21.0 | 21.7 | 24.0 | 21.4 | 20.1 | 19.2 | 19.1 | 21.3 | 17.5 |
| 14 | Cycloparaffin Performance Ratio | GCMS | | 1.3 | 1.3 | 1.3 | 1.2 | 1.0 | 1.0 | 1.0 | 0.9 | 0.8 | 0.8 | 1.0 |
| 15 | 2+R cycloparaffins | GCMS | % | 29.4 | 30.7 | 32.3 | 32.8 | 35.7 | 36.5 | 37.9 | 39.1 | 41.0 | 40.0 | 40.7 |
| 16 | 3+ R cycloparaffins | GCMS | % | 8.2 | 8.9 | 8.3 | 8.6 | 11.0 | 11.0 | 11.4 | 11.7 | 14.2 | 12.5 | 13.0 |
| 17 | 4+ R cycloparaffins | GCMS | % | 3.5 | 3.6 | 2.5 | 2.7 | 3.3 | 3.0 | 3.1 | 3.0 | 4.1 | 3.3 | 3.6 |
| 18 | % epsilon | 13C NMR | % | 10.7 | 11.2 | 11.2 | 11.0 | 12.1 | 12.7 | 12.7 | 12.1 | 9.1 | 9.6 | 12.5 |
| 19 | % T/P Pr | 13C NMR | % | 1.2 | 1.1 | 1.3 | 1.1 | 1.1 | 1.0 | 1.1 | 1.0 | 1.2 | 1.0 | 1.2 |
| 20 | % alpha | 13C NMR | % | 3.2 | 3.2 | 3.2 | 3.0 | 3.3 | 3.2 | 3.3 | 3.2 | 2.7 | 2.9 | 3.4 |
| 21 | % P/T Et | 13C NMR | % | 1.6 | 1.6 | 1.4 | 1.4 | 1.2 | 1.2 | 1.2 | 1.1 | 1.5 | 1.7 | 1.1 |

Fig. 9

| | | | | Examples of Inventive Base stocks | | | | | Ref HN A | Ref HN B | Ref HN C | Ref HN D | Comparative HN A | Comparative HN B | Comparative HN C | Comparative HN D |
|---|---|---|---|---|---|---|---|---|---|---|---|---|---|---|---|---|
| 1 | Kinematic Viscosity at 100 C | ASTM D445 | cSt | 11.87 | 11.97 | 10.56 | 10.88 | 10.25 | 10.42 | 10.48 | 10.63 | 10.45 | 12.11 | 12.23 | 11.97 | 10.46 |
| 2 | Kinematic Viscosity at 40 C | ASTM D445 | Cst | 100.38 | 102.62 | 83.88 | 86.34 | 80.29 | 90.18 | 91.01 | 94.42 | 90.50 | 102.10 | 104.90 | 107.90 | 89.15 |
| 3 | Viscosity Index | | | 107.7 | 106.3 | 109.5 | 111.5 | 109.6 | 96.9 | 96.8 | 94.7 | 97.0 | 109.3 | 107.5 | 99.5 | 99.0 |
| 4 | Total Cycloparaffins | GCMS | % | 70.2 | 70.7 | 73.8 | 74.9 | 72.7 | 80.8 | 80.6 | 80.3 | 80.6 | 76.0 | 80.6 | 82.7 | 81.1 |
| 5 | Sats X 0 (1 Ring CP) | GCMS | % | 41.6 | 41.1 | 39.7 | 39.7 | 39.5 | 35.4 | 35.1 | 34.1 | 35.6 | 37.0 | 38.7 | 37.1 | 35.4 |
| 6 | Sats X -2 (2 Ring CP) | GCMS | % | 20.8 | 21.4 | 25.1 | 25.7 | 24.5 | 29.7 | 29.8 | 29.9 | 29.5 | 28.3 | 30.5 | 31.2 | 30.1 |
| 7 | Sats X -4 (3 Ring CP) | GCMS | % | 4.8 | 5.1 | 6.2 | 6.6 | 5.9 | 11.0 | 10.9 | 11.2 | 10.7 | 7.9 | 8.5 | 10.2 | 10.8 |
| 8 | Sats X -6 (4 Ring CP) | GCMS | % | 1.6 | 1.7 | 1.7 | 1.8 | 1.7 | 3.1 | 3.1 | 3.3 | 3.1 | 2.0 | 2.0 | 2.8 | 3.1 |
| 9 | Sats X -8 (5 Ring CP) | GCMS | % | 0.8 | 0.8 | 0.7 | 0.7 | 0.7 | 1.2 | 1.2 | 1.3 | 1.2 | 0.6 | 0.6 | 1.0 | 1.3 |
| 10 | Sats X -10 (6 Ring CP) | GCMS | % | 0.6 | 0.6 | 0.4 | 0.4 | 0.4 | 0.4 | 0.5 | 0.5 | 0.5 | 0.3 | 0.3 | 0.5 | 0.5 |
| 11 | Sats X 2 (iso-paraffins) | GCMS | % | 29.8 | 29.3 | 26.2 | 25.1 | 27.2 | 19.2 | 19.4 | 19.7 | 19.4 | 24.0 | 19.4 | 17.3 | 18.9 |
| 12 | n- paraffins | GCMS | % | 0.0 | 0.0 | 0.0 | 0.0 | 0.0 | 0.0 | 0.0 | 0.0 | 0.0 | 0.0 | 0.0 | 0.0 | 0.0 |
| 12 | MM-Paraffins | GCMS | % | 0.5 | 0.5 | 0.4 | 0.4 | 0.5 | 0.7 | 0.7 | 0.8 | 0.9 | 0.4 | 0.5 | 0.3 | 0.5 |
| 13 | DM-Paraffins | GCMS | % | 29.3 | 28.6 | 25.8 | 24.7 | 26.8 | 18.6 | 18.7 | 18.7 | 18.5 | 23.6 | 18.9 | 17.0 | 18.4 |
| 14 | CycloParaffin Performance Ratio | GCMS | | 1.5 | 1.4 | 1.5 | 1.4 | 1.5 | 1.0 | 1.0 | 1.0 | 1.0 | 1.2 | 1.2 | 1.0 | 1.0 |
| 15 | 2+R cycloparaffins | GCMS | % | 28.6 | 29.6 | 34.1 | 35.2 | 33.2 | 45.4 | 45.5 | 46.2 | 45.0 | 39.1 | 42.0 | 45.7 | 45.7 |
| 16 | 3+ R cycloparaffins | GCMS | % | 7.8 | 8.2 | 9.0 | 9.5 | 8.7 | 15.7 | 15.7 | 16.3 | 15.5 | 10.8 | 11.4 | 14.4 | 15.6 |
| 17 | 4+ R cycloparaffins | GCMS | % | 3.0 | 3.1 | 2.8 | 2.9 | 2.8 | 4.7 | 4.8 | 5.1 | 4.8 | 2.9 | 2.9 | 4.3 | 4.8 |
| 18 | % epsilon | 13C NMR | % | 13.3 | 14.0 | 13.6 | 14.7 | 14.0 | 11.6 | 12.1 | 10.9 | 12.2 | 12.5 | 13.6 | 13.0 | 11.8 |
| 19 | % T/P Pr | 13C NMR | % | 1.0 | 1.0 | 1.0 | 1.0 | 1.0 | 1.0 | 0.9 | 0.9 | 0.9 | 1.0 | 0.8 | 0.8 | 1.3 |
| 20 | % alpha | 13C NMR | % | 2.8 | 2.9 | 2.9 | 2.8 | 3.0 | 2.6 | 2.7 | 2.6 | 2.6 | 2.8 | 2.6 | 2.7 | 2.7 |
| 21 | % P/T Et | 13C NMR | % | 1.5 | 1.2 | 1.2 | 1.1 | 1.2 | 1.0 | 1.0 | 1.0 | 0.9 | 1.8 | 1.1 | 1.0 | 1.4 |

Fig. 10

| | Inventive LN A | Inventive LN B | Inventive LN C | Inventive HN A | Inventive HN B | Inventive HN C | Inventive HN D | Inventive HN E |
|---|---|---|---|---|---|---|---|---|
| Kinematic Viscosity at 40 deg C, mm2/s | 30.5 | 30.7 | 27.4 | 100.4 | 102.6 | 83.9 | 86.3 | 80.3 |
| Kinematic Viscosity at 100 deg C, mm2/s | 5.4 | 5.4 | 5.0 | 11.9 | 12.0 | 10.6 | 10.8 | 10.2 |
| Viscosity Index | 110.5 | 110.4 | 111.4 | 107.7 | 106.3 | 109.5 | 110.3 | 109.6 |
| Density at 15 deg C, g/cm3 | 0.8542 | 0.8545 | 0.8515 | 0.8649 | 0.8698 | 0.8631 | 0.8633 | 0.8623 |
| Pour Point, C | -21 | -21 | | -14 | -14 | -18 | -9 | -13 |
| UV Absorptivity at 226 nm, L/g-cm | 0.06 | 0.06 | 0.27 | 0.08 | 0.08 | 0.33 | 0.345 | 0.251 |
| UV Absorptivity at 254 nm, L/g-cm | 0.002 | 0.002 | 0.016 | 0.005 | 0.005 | 0.039 | 0.04 | 0.023 |
| UV Absorptivity at 275 nm, L/g-cm | 0.004 | 0.004 | 0.025 | 0.008 | 0.008 | 0.044 | 0.0453 | 0.0288 |
| UV Absorptivity at 302 nm, L/g-cm | 0.0014 | 0.0013 | 0.011 | 0.0111 | 0.0088 | 0.0443 | 0.0454 | 0.0277 |
| UV Absorptivity at 310 nm, L/g-cm | 0.0011 | 0.001 | 0.0087 | 0.0152 | 0.0127 | 0.0712 | 0.0727 | 0.0441 |
| UV Absorptivity at 325 nm, L/g-cm | 0.0003 | 0.0003 | 0.0028 | 0.0057 | 0.0042 | 0.0192 | 0.0193 | 0.0122 |
| Total Saturates, mass% | >99.8 | 99.8 | | 99.7 | 99.7 | | | |

Fig. 15

| | US 9,487,723 | | | Current Application | | | |
|---|---|---|---|---|---|---|---|
| | Prior Art Gp II 4.5 cSt | Inventive 4.5 cSt | Ratio of Inventive 4.5 cSt vs Prior art | Inventive 5 cSt | Inventive 11+ cSt | Ratio of Inventive 5 cSt vs Prior Art | Ratio of Inventive 11+ cSt vs Prior Art |
| UV Absorptivity at 226 nm, L/g-cm | 0.12 | 0.09 | 0.8 | 0.27 | 0.08 | 2.3 | 0.7 |
| UV Absorptivity at 254 nm, L/g-cm | 0.007 | 0.019 | 2.7 | 0.016 | 0.005 | 2.3 | 0.7 |
| UV Absorptivity at 275 nm, L/g-cm | 0.011 | 0.022 | 2.0 | 0.025 | 0.008 | 2.3 | 0.7 |
| UV Absorptivity at 302 nm, L/g-cm | 0.0064 | 0.0505 | 7.9 | 0.011 | 0.00995 | 1.7 | 1.6 |
| UV Absorptivity at 310 nm, L/g-cm | 0.0073 | 0.0370 | 5.1 | 0.0087 | 0.01395 | 1.2 | 1.9 |
| UV Absorptivity at 325 nm, L/g-cm | 0.0020 | 0.0106 | 5.3 | 0.0028 | 0.00495 | 1.4 | 2.5 |
| UV Absorptivity at 339 nm, L/g-cm | 0.0015 | 0.0147 | 9.8 | 0.0017 | 0.00245 | 1.1 | 1.6 |
| UV Absorptivity at 400 nm, L/g-cm | 0.00016 | 0.00112 | 7.0 | 0.00023 | 0.000365 | 1.4 | 2.3 |

Fig. 16

BASE STOCKS AND LUBRICANT COMPOSITIONS CONTAINING SAME

CROSS-REFERENCE TO RELATED APPLICATIONS

This application is a divisional of U.S. application Ser. No. 15/468,380, filed Mar. 24, 2017, which claims priority to U.S. Provisional Application Ser. No. 62/315,808 filed Mar. 31, 2016 and U.S. Provisional Application Ser. No. 62/356,749 filed Jun. 30, 2016, all of which are herein incorporated by reference in their entirety.

FIELD

This disclosure relates to base stocks, blends of base stocks, formulated lubricant compositions containing the base stocks, and uses of base stocks. This disclosure also relates to methods for improving oxidation performance and low temperature performance of formulated lubricant compositions through compositionally advantaged base stocks.

BACKGROUND

Engine oils are finished crankcase lubricants intended for use in automobile engines and diesel engines and consist of two general components, namely, a base stock or base oil (one base stock or a blend of base stocks) and additives. Base oil is the major constituent in these finished lubricants and contributes significantly to the properties of the engine oil. In general, a few lubricating base oils are used to manufacture a variety of engine oils by varying the mixtures of individual lubricating base oils and individual additives.

Governing organizations (e.g., the American Petroleum Institute) help to define the specifications for engine oils. Increasingly, the specifications for engine oils are calling for products with excellent low temperature properties and high oxidation stability. Currently, only a small fraction of the base oils blended into engine oils are able to meet the most stringent of the demanding engine oil specifications. Currently, formulators are using a range of base stocks spanning the range including Group I, II, III, IV, and V to formulate their products.

Base oils are generally recovered from the higher boiling fractions recovered from a vacuum distillation operation. They may be prepared from either petroleum-derived or from syncrude-derived feed stocks. Additives are chemicals which are added to improve certain properties in the finished lubricant so that it meets the minimum performance standards for the grade of the finished lubricant. For example, additives added to the engine oils may be used to improve stability of the lubricant, increase its viscosity, raise the viscosity index, and control deposits. Additives are expensive and may cause miscibility problems in the finished lubricant. For these reasons, it is generally desirable to lower the additive content of the engine oils to the minimum amount necessary to meet the appropriate requirements.

Formulations are undergoing changes driven by need for increased quality. Changes are seen in engine oils with need for excellent low temperature properties and oxidation stability and these changes continue as new engine oils categories are being developed. Industrial oils are also being pressed for improved quality in oxidation stability, cleanliness, interfacial properties, and deposit control.

Despite advances in lubricating base oils and lubricant oil formulation technology, there exists a need for improving oxidation performance (for example, for engine oils and industrial oils that have a longer life) and low temperature performance of formulated oils. In particular, there exists a need for improving oxidation performance and low temperature performance of formulated oils without the addition of more additives to the lubricant oil formulation.

SUMMARY

This disclosure relates to base stocks and to formulated lubricant compositions containing the base stocks. This disclosure also relates to methods for improving oxidation performance and low temperature performance of formulated lubricant compositions through compositionally advantaged base stocks.

This disclosure relates in part to a base stock having a kinematic viscosity at 100° C. of between about 4 and about 6 cSt. These base stocks are also referred to as low viscosity base stocks, low viscosity lubricating oil base stocks or low viscosity products in the present disclosure. The base stock comprises greater than or equal to about 90 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and has a cycloparaffin performance ratio greater than about 1.05, and a kinematic viscosity at 100° C. between about 4 and about 6 cSt.

This disclosure relates in part to a base stock having a kinematic viscosity at 100° C. of between about 5 and about 6 cSt. These base stocks are also referred to as low viscosity base stocks, low viscosity lubricating oil base stocks or low viscosity products in the present disclosure. The base stock comprises greater than or equal to about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; has a Viscosity Index of >100 or preferably >110, has a cycloparaffin performance ratio greater than about 1.05, and a kinematic viscosity at 100° C. between about 5 and about 6 cSt.

This disclosure also relates in part to a lubricating oil having a composition comprising a base stock as a major component, and one or more additives as a minor component. The base stock has a kinematic viscosity at 100° C. between about 4 and about 6 cSt, and comprises: greater than or equal to about 90 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and has a cycloparaffin performance ratio greater than about 1.05.

In an embodiment, the lubricating oils comprising a base stock having a kinematic viscosity at 100° C. between about 4 and about 6 cSt of this disclosure have improved oxidation performance as compared to oxidation performance of a lubricating oil containing a base stock other than the base stock of this disclosure, as measured by a rotating pressure vessel oxidation test (RPVOT) by ASTM D2272.

In another embodiment, the lubricating oils comprising a base stock having a kinematic viscosity at 100° C. between about 4 and about 6 cSt of this disclosure have improved oxidation stability as compared to oxidation stability of a lubricating oil containing a base stock other than the base stock of this disclosure, as measured by a B10 oxidation test.

In a further embodiment, the lubricating oils comprising a base stock having a kinematic viscosity at 100° C. between about 4 and about 6 cSt of this disclosure have improved low temperature performance as compared to low temperature performance of a lubricating oil containing a base stock other than the base stock of this disclosure, as measured by a mini-rotary viscometer (MRV) by ASTM D4684.

This disclosure further relates in part to a method for improving oxidation performance of a lubricating oil as measured by a rotating pressure vessel oxidation test (RPVOT) by ASTM D2272. The lubricating oil comprises a base stock having a kinematic viscosity at 100° C. between about 4 and about 6 cSt as a major component; and one or more additives as a minor component.

The base stock comprises greater than or equal to about 90 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and has a cycloparaffin performance ratio greater than about 1.05. The method comprises controlling the cycloparaffin performance ratio to achieve a ratio greater than about 1.1.

This disclosure yet further relates in part to a method for improving low temperature performance of a lubricating oil as measured by a mini-rotary viscometer (MRV) by ASTM D4684. The lubricating oil comprises a base stock having a kinematic viscosity at 100° C. between about 4 and about 6 cSt as a major component, and one or more additives as a minor component. The base stock comprises greater than or equal to about 90 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and has a cycloparaffin performance ratio greater than about 1.05. The method comprises controlling the cycloparaffin performance ratio to achieve a ratio greater than about 1.1; controlling monocycloparaffinic species greater than about 41 wt. %, based on the total wt. % of all saturates and aromatics; and/or controlling iso-paraffinic species greater than about 21 wt. %, based on the total wt. % of all saturates and aromatics.

This disclosure relates in part to a base stock having a kinematic viscosity at 100° C. between about 10 and about 14 cSt. These base stocks are also referred to as high viscosity base stocks, high viscosity lubricating oil base stocks or high viscosity products in the present disclosure. The base stock comprises; at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt.

This disclosure relates in part to a base stock having a kinematic viscosity at 100° C. between about 10 and about 14 cSt, a viscosity index (VI) from about 80 to about 120, and preferably a VI of from about 100 to 120, and a pour point less than about −12° C. The base stock comprises: at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt.

This disclosure also relates in part to a lubricating oil having a composition comprising a base stock as a major component, and one or more additives as a minor component. The base stock has a kinematic viscosity at 100° C. between about 10 and about 14 cSt, and comprises: at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05.

This disclosure also relates in part to a lubricating oil having a composition comprising a base stock as a major component, and one or more additives as a minor component. The base stock has a kinematic viscosity at 100° C. between about 10 and about 14 cSt, a viscosity index (VI) from about 80 to about 120, and a pour point less than about −12° C., and comprises: at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05.

In an embodiment, the lubricating oils comprising a base stock having a kinematic viscosity at 100° C. between about 10 and about 14 cSt of this disclosure have improved oxidation performance as compared to oxidation performance of a lubricating oil containing a base stock other than the base stock of this disclosure, as measured by a rotating pressure vessel oxidation test (RPVOT) by ASTM D2272.

In another embodiment, the lubricating oils comprising a base stock having a kinematic viscosity at 100° C. between about 10 and about 14 cSt of this disclosure have improved oxidation stability as compared to oxidation stability of a lubricating oil containing a base stock other than the base stock of this disclosure, as measured by a B10 oxidation test.

In a further embodiment, the lubricating oils comprising a base stock having a kinematic viscosity at 100° C. between about 10 and about 14 cSt of this disclosure have improved low temperature performance as compared to low temperature performance of a lubricating oil containing a base stock other than the base stock of this disclosure, as measured by a mini-rotary viscometer (MRV) by ASTM D4684.

In a further embodiment, a base stock blend is provided that includes from 5 to 95 wt. % of a first base stock and from 5 to 95 wt. % of a second base stock, The first base stock comprises: greater than or equal to about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and has a cycloparaffin performance ratio greater than about 1.1 and a kinematic viscosity at 100° C. between about 4 and about 6 cSt. The second base stock comprises: at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt.

This disclosure further relates in part to a method for improving oxidation performance of a lubricating oil as measured by a rotating pressure vessel oxidation test (RPVOT) by ASTM D2272. The lubricating oil comprises a base stock having a kinematic viscosity at 100° C. between about 10 and about 14 cSt, as a major component; and one or more additives as a minor component. The base stock comprises: at least about 90 wt. % saturates, preferably greater than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt. The method comprises controlling the cycloparaffin performance ratio to achieve a ratio greater than about 1.05.

This disclosure further relates in part to a method for improving oxidation performance of a lubricating oil as measured by a rotating pressure vessel oxidation test (RPVOT) by ASTM D2272. The lubricating oil comprises a base stock having a kinematic viscosity at 100° C. between about 10 and about 14 cSt, a viscosity index (VI) from about 80 to about 120, and a pour point less than about −12° C., as a major component; and one or more additives as a minor component. The base stock comprises: at least about 90 wt. % saturates, preferably great than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.3 and a kinematic viscosity at 100° C. between about 10 and about 14 cSt. The method comprises controlling the cycloparaffin performance ratio to achieve a ratio greater than about 1.05.

This disclosure yet further relates in part to a method for improving low temperature performance of a lubricating oil as measured by a mini-rotary viscometer (MRV) by ASTM D4684. The lubricating oil comprises a base stock having a kinematic viscosity at 100° C. between about 10 and about 14 cSt, as a major component, and one or more additives as a minor component. The base stock comprises: at least about 90 wt. % saturates, preferably great than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt. The method comprises controlling the cycloparaffin performance ratio to achieve a ratio greater than about 1.05; controlling monocycloparaffinic species greater than about 39 wt. %, based on the total wt. % of all saturates and aromatics; and/or controlling iso-paraffinic species greater than about 25 wt. %, based on the total wt. % of all saturates and aromatics.

This disclosure yet further relates in part to a method for improving low temperature performance of a lubricating oil as measured by a mini-rotary viscometer (MRV) by ASTM D4684. The lubricating oil comprises a base stock having a kinematic viscosity at 100° C. between about 10 and about 14 cSt, a viscosity index (VI) from about 80 to about 120, and a pour point less than about −12° C., as a major component, and one or more additives as a minor component. The base stock comprises: at least about 90 wt. % saturates, preferably great than 98 wt. % saturates; an amount and distribution of aromatics, as determined by ultra violet (UV) spectroscopy, comprising an absorptivity between 280 and 320 nm of less than about 0.020 l/gm-cm, preferably less than about 0.015 l/gm-cm; and having a cycloparaffin performance ratio greater than about 1.05 and a kinematic viscosity at 100° C. between about 10 and about 14 cSt. The method comprises controlling the cycloparaffin performance ratio to achieve a ratio greater than about 1.05; controlling monocycloparaffinic species greater than about 39 wt. %, based on the total wt. % of all saturates and aromatics; controlling iso-paraffinic species greater than about 25 wt. %, based on the total wt. % of all saturates and aromatics.

It has been surprisingly found that, in accordance with this disclosure, oxidation performance of a formulated oil can be improved by controlling either the total cycloparaffin and naphthenoaromatic content or the relative amounts of multi-ring cycloparaffin species and naphthenoaromatic species in the base oil used to blend the formulated oil. Further, in accordance with this disclosure, it has been surprisingly found that low temperature performance of a formulated oil can be improved by increasing the amounts of iso-paraffin and monocycloparaffin species and/or modifying the iso-paraffinic species in the base oil used to blend the formulated oil.

Other objects and advantages of the present disclosure will become apparent from the detailed description that follows.

BRIEF DESCRIPTION OF THE DRAWINGS

FIG. 8 shows illustrative multi-ring cycloparaffins and naphthenoaromatics of X-class and Z-class according to an embodiment of the disclosure.

FIG. 9 shows the composition and properties of exemplary low viscosity base stocks of this disclosure compared with the composition of reference low viscosity base stocks.

FIG. 10 shows the composition and properties of exemplary high viscosity base stocks of this disclosure compared with the composition of reference high viscosity base stocks.

FIG. 15 shows the physical properties and distribution of aromatics, as determined by ultra violet (UV) spectroscopy, of exemplary low viscosity and high viscosity base stocks of this disclosure.

FIG. 16 shows a comparison of the amount and distribution of aromatics, as determined by ultra violet (UV) spectroscopy, in lubricating oil base stocks (i.e., a 4.5 cSt base stock of U.S. Patent application Publication No. 2013/0264246, a 4.5 cSt state of the art base stock as disclosed in U.S. Patent application Publication No. 2013/0264246, a 5 cSt base stock of this disclosure, and a 11+ cSt base stock of this disclosure).

DETAILED DESCRIPTION

Figure 1:
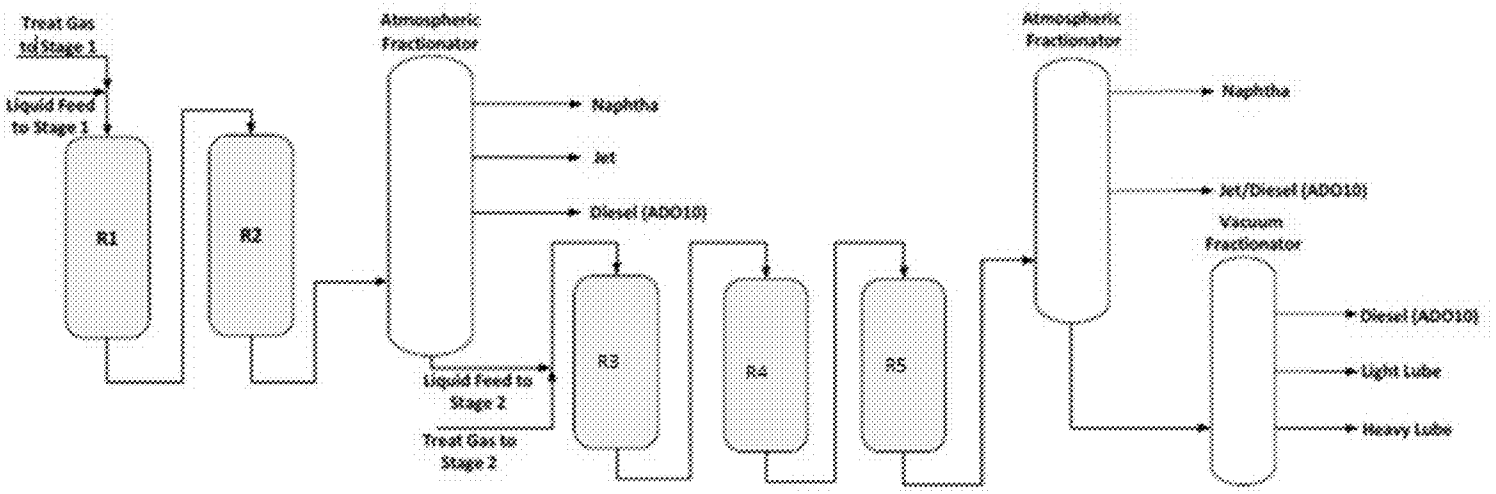
FIG. 1 schematically shows an example of a multi-stage reaction system according to an embodiment of the disclosure.

All numerical values within the detailed description and the claims herein are modified by "about" or "approximately" the indicated value, and take into account experimental error and variations that would be known to a person of ordinary skill in the art.

The viscosity-temperature relationship of a lubricating oil is one of the critical criteria which must be considered when selecting a lubricant for a particular application. Viscosity Index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements.

In another aspect, as the oil operating temperature decreases, the viscosity of a high VI oil will not increase as much as the viscosity of a low VI oil. This is advantageous because the excessive high viscosity of the low VI oil will decrease the efficiency of the operating machine. Thus high VI (HVI) oil has performance advantages in both high and low temperature operation. VI is determined according to ASTM method D 2270-93 [1998]. VI is related to kinematic viscosities measured at 40° C. and 100° C. using ASTM Method D 445-01.

As used herein, the term "major component" means a component (e.g., base stock) present in a lubricating oil of this disclosure in an amount greater than about 50 weight percent.

As used herein, the term "minor component" means a component (e.g., one or more lubricating oil additives) present in a lubricating oil of this disclosure in an amount less than about 50 weight percent.

Lubricating Oil Base Stocks

In accordance with this disclosure, base oil compositions or lubricating oil base stocks are provided having different relative amounts of monocycloparaffin and multi-ring cycloparaffin species and naphthenoaromatic species than known previously for commercial base stocks. According to various embodiments of the disclosure, the base stocks are API Group II or Group III base stocks, in particular API Group II base stocks. Also, in accordance with this disclosure, a method is provided to improve oxidation performance of a formulated oil by controlling either the total cycloparaffin and naphthenoaromatic content or the relative amounts of multi-ring cycloparaffin species and naphthenoaromatic species in the base oil used to blend the formulated oil. Further, in accordance with this disclosure, a method is provided to improve the low temperature performance of a formulated oil by increasing the amounts of iso-paraffin and monocycloparaffin species and/or modifying the iso-paraffinic species in the base oil used to blend the formulated oil.

The methods described herein are used to make the unique lubricating oil base stocks which provide improved low temperature properties in engine oil formulations and oxidation performance in turbine oil formulations. The compositional advantage of the unique lubricating oil base stocks is believed to be derived from the saturates portion of the distribution including molecular arrangements comprised of isomers. This disclosure provides methods to control the low temperature and oxidation performance of lubricating oil base stocks, such as formulated oil MRV (mini-rotary viscometer) for low temperature performance measured by ASTM D4684, or formulated oil RPVOT (rotating pressure vessel oxidation test) for oxidation performance measured by ASTM D2272, by increasing the content of the advantaged species or controlling the content of the bad acting species identified herein. The lubricating oils of this disclosure are particularly advantageous as passenger vehicle engine oil (PVEO) products.

The lubricating oil base stocks of this disclosure provide several advantages over typical conventional lubricating oil base stocks including, but not limited to, improved low temperature properties in engine oils such as MRV apparent viscosity measured by ASTM D4684 and improved oxidation performance such as RPVOT oxidation stability time measured by ASTM D2272 in turbine oils. The hydrocracking process used in this disclosure provides flexibility for additional ring saturation, ring opening, hydrocracking and isomerization of the hydrocarbon molecules in the base stocks.

As used herein, multi-ring cycloparaffins and naphthenoaromatics can be categorized as X-class and Z-class. FIG. 8 shows illustrative multi-ring cycloparaffins and naphthenoaromatics of X-class and Z-class according to an embodiment of the disclosure. Referring to FIG. 8, the addition of paraffinic side chains to any ring structure will not change the X-class. This can be seen in the predominant species, as a saturated alkyl side chain would be of the formula $C_mH_{2m}$. So the addition of $C_mH_{2m}$ to $C_nH_{2n+x}$=$C_{(n+m)}H_{2(n+m)+x}$ which is still of the formula $C_nH_{2n+x}$.

Further, referring to FIG. 8, alkyl naphthenoaromatic species obey the formula $C_nH_{2n+z}$, with Z=−2 (rings+double bonds−1); giving the Z-class of the molecule. Z-class translates to X-class by a wrap-around. So, up to Z=−10, X-class and Z-class are identical. But Z-class of −12 is same as X-class of +2; Z-class of −14 is same as X-class of 0; and so on given by the formula: (multiples of) 14 minus Z-class, such that X-class of 2, 0, −2, −4, −6, −8 or −10 is obtained. Z-class will also work for hetero-naphthenoaromatic species having the formula $C_nH_{2n+z}Y$ where Y is a heteroatom (S, N, and the like). These are Group II base stocks with very little content of heteroatomic hydrocarbon species. The Z-class definition is described by Klaus H. Altgelt and Mieczyslaw M. Boduszynski, Composition and Analysis of Heavy Petroleum Fractions, CRC Press, 1993.

In accordance with this disclosure, the Group II base stocks with unique compositions (examples in FIGS. 9 and 10) are produced by a hydrocracking process using a feed stock (i.e., a vacuum gas oil feed stock having a solvent dewaxed oil feed viscosity index of from about 20 to about 45) and exhibit a range of base stock viscosities from 3.5 cst to 13 cst. The differences in composition include a difference in distribution of the cycloparaffin and naphthenoaromatic ring species and lead to larger relative amounts of one ring compared to multi-ring cycloparaffins and naphthenoaromatics. FIGS. 9 and 10, referring to line 14 in each, show a cyloparaffin performance ratio that exceeds 1.1 in the low viscosity base stocks of this disclosure, and that exceeds 1.2 in the high viscosity base stocks of this disclosure.

The cycloparaffin performance ratio for base stocks having a kinematic viscosity at 100° C. of greater than 8 cSt, i.e., the cycloparaffin performance ratio of the high viscosity base stocks of the present disclosure, was calculated as the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) in said base stock relative to the same ratio in a heavy neutral Group II commercially available sample in 2016 or earlier with a kinematic viscosity at 100° C. within 0.3 cSt as the test sample, wherein the amounts of monocycloparaffinic to multi-ring cycloparaffinic and naphthenoaromatic species are all measured using GCMS on the same instrument at the same calibration.

Similarly, for base stocks with a kinematic viscosity at 100° C. lower than 8 cSt, i.e., the cycloparaffin performance ratio of the low viscosity base stocks of the present disclosure, the cycloparaffin performance ratio was calculated as the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) in said base stock relative to same ratio in a light neutral Group II commercially available sample in 2016 or earlier with a kinematic viscosity at 100° C. within 0.3 cSt as the test sample, wherein the amounts of monocycloparaffinic to multi-ring cycloparaffinic and naphthenoaromatic species are all measured using GCMS on the same instrument at the same calibration.

Additionally, in the base stocks of this disclosure, the absolute value of multi-ring cycloparaffins and naphthenoaromatics as shown in FIGS. 9 and 10, rows 15, 16, and 17 of each, for 2+, 3+, 4+ ring cycloparaffins and naphthenoaromatics is lower in the base stocks of this disclosure as compared to commercially known base stocks across the range of viscosities. Specifically, the example base stocks of this disclosure show less than 35.7% species with −2 X-class as shown in FIG. 8, predominantly 2+ ring cycloparaffins and naphthenoaromatics of −2 X-class, less than 11.0% species with −4 X-class as shown in FIG. 8, predominantly 3+ ring cycloparaffins and naphthenoaromatics of −4 X-class, and less than 3.7% species with −6 X-class as shown in FIG. 8, predominantly 4+ ring cycloparaffins and naphthenoaromatics of −6 X-class, in the low viscosity product, and less than 39% species with −2 X-class as shown in FIG. 8, predominantly 2+ ring cycloparaffins and naphthenoaromatics of −2 X-class, less than 10.8% species with −4 X-class as shown in FIG. 8, predominantly 3+ ring cycloparaffins and naphthenoaromatics of −4 X-class, and less than 3.2% species with −6 X-class as shown in FIG. 8, predominantly 4+ ring cycloparaffins and naphthenoaromatics of −6 X-class, for the high viscosity product. The lower amounts of the multi-ring cycloparaffins and naphthenoaromatics can also be seen by looking at individual numbers of 3 ring species (FIGS. 9 and 10, line 7 of each); less than 7.8% for the low viscosity product and less than 7.9% for the high viscosity product. Additionally, the base stocks of this disclosure also show higher amounts of the monocycloparaffin species across the full viscosity range; greater than 40.7% for the low viscosity base stocks and greater than 38.8% for the high viscosity base stocks. In addition, the base stocks of this disclosure can include naphthenoaromatic species of correspondingly the same X-class as shown in FIG. 8, preferably a total amount less than 5%, and more preferably a total amount less than 2%.

Further, using a wide cut feed gives additional advantages on the heavier base stocks co-produced with the lighter base stocks. As seen in FIG. 10, line 4 thereof, the high viscosity stocks show significantly lower total cycloparaffin content (less than 75%) compared to commercial base stocks, averaging closer to 80%.

Additionally, both the low and high viscosity base stocks show higher VI, the high viscosity base stocks of this disclosure having VI in the 106-112 range, e.g. up to 109-112 range.

Furthermore, the low and high viscosity base stocks of this disclosure may have saturates of greater than 95 wt %, or greater than 98 wt %, or greater than 99 wt % saturates in total.

Additionally, the high viscosity base stocks show lower degree of branching on the iso-paraffin portion of the species as evidenced by greater than 13.3 epsilon carbon atoms per 100 carbon atoms as measured by 13C-NMR, and a greater number of long alkyl branches on iso-paraffin portion of the species as evidence by greater than 2.8 alpha carbon atoms per 100 carbon atoms as measured by 13C-NMR (FIG. 10, lines 18 and 20). Some unique combinations of properties are also seen specifically in the low viscosity base stock co-produced with the high viscosity product. For example, the low viscosity base stocks of this disclosure have epsilon carbon content less than 12% while retaining viscosity index greater than 110 (FIG. 9, lines 18 and 3).

A detailed summary of compositional characteristics of exemplary base stocks of this disclosure included in FIGS. 9 and 10 is set forth below.

For base stocks with a kinematic viscosity in the range 4-6 cSt at 100° C., or between 5-6 cSt at 100° C., the composition is preferably such that:

monocycloparaffinic species, as measured by GCMS, constitute greater than 44% or 46% or 48% of all species; preferably greater than 46%, more preferably greater than 47%, and even more preferably greater than 48% of all species;

the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) relative to the same ratio in a similar commercially available hydroprocessed base stock (cycloparaffin performance ratio (CPR)) is greater than 1.05, or 1.1, or 1.2, or 1.3, or 1.4, or 1.5, or 1.6 as measured by GCMS; preferably greater than 1.2, more preferably greater than 1.4, and even more preferably greater than 1.6 as measured by GCMS;

the sum of all species with hydrogen deficiency X-class of −2, −4, −6, −8 and −10, as measured by GCMS, i.e., 2+ ring cycloparaffinic and naphthenoaromatic species constitute less than <34% or <33% or <31% or <30% of all species; preferably less than 34%, more preferably less than 33%, and even more preferably less than 30%;

the sum of all species with hydrogen deficiency X-class of −4, −6, −8 and −10, as measured by GCMS, i.e., 3+ ring cycloparaffinic and naphthenoaromatic species constitute less than 10.5% or <9.5% or <9% or <8.5% of all species; preferably less than 10.5%, more preferably less than 10%, and even more preferably less than 9%;

the sum of all species with hydrogen deficiency X-class of −6, −8 and −10, as measured by GCMS, i.e. 4+ ring cycloparaffinic and naphthenoaromatic species constitute less than 2.9% or <2.7% or <2.6% of all species; preferably less than 2.95%, more preferably less than 2.7%, and even more preferably less than 2.5%;

longer branches on iso-paraffin/alkyl portion of the species evidenced by greater than 1.1 tertiary or pendant propyl groups per 100 carbon atoms as measured by 13C-NMR; preferably greater than 1.2 and more preferably greater than 1.25 tertiary or pendant propyl groups per 100 carbon atoms as measured by 13C-NMR; and monomethyl paraffin species, as measured by GCMS, constitute <1.3%, or <1.1%, or <0.9%, or <0.8%, or <0.7% of all species; preferably less than 1.3%, more preferably less than 0.8%, and even more preferably less than 0.6%.

For base stocks with a kinematic viscosity in the range 10-14 cSt at 100° C., the composition is preferably such that:

monocycloparaffinic species, as measured by GCMS, constitute greater than 39% or >39.5% or >40% or >41% of all species; preferably greater than 39%, more preferably greater than 40%, and even more preferably greater than 41.5% of all species;

the sum of cycloparaffinic and naphthenoaromatic species, i.e., all species with hydrogen deficiency X-class of 0, −2, −4, −6, −8, and −10 constitute <73% or <72% or <71% of all species; preferably less than 73%, more preferably less than 72%, and even more preferably less than 70.5%;

the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) relative to the same ratio in a similar commercially available hydroprocessed base stock (cycloparaffin performance ratio) is greater than 1.05, or >1.1, or >1.2 or >1.3 or >1.4 as measured by GCMS; preferably greater than 1.2, more preferably greater than 1.4, and even more preferably greater than 1.6 as measured by GCMS;

the sum of all species with hydrogen deficiency X-class of −2, −4, −6, −8 and −10, as measured by GCMS, i.e. 2+ ring cycloparaffinic and naphthenoaromatic species constitute less than <36% or <35% or <34% or <32% or <30% of all species; preferably less than 36%, more preferably less than 32%, and even more preferably less than 30%;

the sum of all species with hydrogen deficiency X-class of −4, −6, −8 and −10, as measured by GCMS, i.e., 3+ ring cycloparaffinic and naphthenoaromatic species constitute less than 10.5%, or <10% or <9% or <8% of all species; preferably less than 10.5%, more preferably less than 9%, and even more preferably less than 8%;

the sum of all species with hydrogen deficiency X-class of −6, −8 and −10, as measured by GCMS, i.e., 4+ ring cycloparaffinic and naphthenoaromatic species constitute less than 2.8%, or <2.8% of all species; preferably less than 2.8%, more preferably less than 2.7%, and even more preferably less than 2.5%;

higher degree of branching on iso-paraffin/alkyl portion of the species evidenced by greater than 13, or >14 or >14.5 epsilon carbon atoms per 100 carbon atoms as measured by 13C-NMR; preferably greater than 13, more preferably greater than 14, and even more preferably greater than 14.5 epsilon carbon atoms per 100 carbon atoms as measured by 13C-NMR;

greater number of long alkyl branches on iso-paraffin/alkyl portion of the species evidenced by greater than 2.7, or >2.8, or >2.85, or >2.9, or >2.95 alpha carbon atoms per 100 carbon atoms as measured by 13C-NMR; preferably greater than 2.8, more preferably greater than 2.9, and even more preferably greater than 2.95 alpha carbon atoms per 100 carbon atoms as measured by 13C-NMR; and residual wax distribution characterized by rapid rate of heat flow increase (0.0005-0.0015 W/g·T) with the melting of microcrystalline wax by the DSC method.

The base stocks of this disclosure have lower contents of total cycloparaffins as compared to the typical Group II base stocks. This is believed to provide the VI advantage of the base stocks of this disclosure over competitive base stocks. Surprisingly, the base stocks of this disclosure also have higher content of the X-class 0 ring species (corresponding to monocycloparaffinic species), despite the lower overall cycloparaffin content and naphthenoaromatic species content. While not being bound by theory, one hypothesis for the lower amounts of multi-ring cycloparaffins and naphthenoaromatics is that ring opening reactions that lead to low multi-ring cycloparaffins and naphthenoaromatics may have high selectivity under the process conditions used to make the base stocks of this disclosure. The process scheme used to make the base stocks of this disclosure enables greater use of noble metal catalysts having acidic sites under low sulphur (sweet) processing conditions that may favor ring opening reactions that potentially improve VI.

In accordance with this disclosure, a method to improve MRV measured by ASTM D4684 by increasing amounts of iso-paraffin and monocycloparaffin species is provided. As described herein, the base stocks of this disclosure have a lower multi-ring cycloparaffin and naphthenoaromatic content and a higher monocycloparaffin content that may be contributing to the improvement in low temperature performance. This is surprising because relatively small changes in cycloparaffin content would not be expected to influence low temperature performance. There is believed to be an interesting distribution of saturated species including cycloparaffins and/or branched long chain paraffins that may be contributing. Thus, in an embodiment, this disclosure provides a method to improve the MRV performance measured by ASTM D4684 by converting multi-ring cycloparaffins down to mono-cycloparaffins by more severe processing and then blending this base oil with low multi-ring cycloparaffinic species into formulations.

In accordance with this disclosure, a method is provided to improve rotary pressure vessel oxidation test (RPVOT) measured by ASTM D2272 by reducing the multi-ring cycloparaffinic species and naphthenoaromatic species. The base stocks of this disclosure, in particular higher viscosity base stocks, show directionally lower amounts of cycloparaffins than similar viscosity API Group II base stocks. Also, individual cycloparaffin type molecules distribution in such base stocks is different than those for similar viscosity competitive Group II base stocks. The overall compositional difference in the base stocks of this disclosure results in the directionally better oxidative stability as measured by RPVOT by ASTM D2272 on turbine oil formulations. While not being limited by the theory, it is believed that the certain type of cycloparaffinic molecules are preferred over other types of cycloparaffinic molecules for providing better oxidation stability either by inhibition in the oxidation initiation reactions or perhaps keep oxidation product in the solution. It is also believed that iso-paraffinic molecules may be even more preferred than cycloparaffinic type molecules. This results in higher RPVOT average time. Thus, this disclosure provides a method to control the oxidative stability by specifically reducing the multi-ring cycloparaffinic species and naphthenoaromatic species per the compositional space as follows:

overall cycloparaffin molecules content 2-7% lower than the competitive base stocks;

single ring class cycloparaffinic molecules were 2-4% higher;

two rings class cycloparaffinic molecules were 2-5% lower;

three rings class cycloparaffinic molecules were 1-6% lower; and sum of all 4 hydrogen deficient class and naphthenoaromatic molecules is about 10% which is about 2-6% lower.

The base oil constitutes the major component of the engine or other mechanical component oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. As described herein, additives constitute the minor component of the engine or other mechanical component oil lubricant composition of the present disclosure and typically are present in an amount ranging from about less than 50 weight percent, preferably less than about 30 weight percent, and more preferably less than about 15 weight percent, based on the total weight of the composition.

Mixtures of base oils may be used if desired, for example, a base stock component and a cobase stock component. The cobase stock component is present in the lubricating oils of this disclosure in an amount from about 1 to about 99 weight percent, preferably from about 5 to about 95 weight percent, and more preferably from about 10 to about 90 weight percent. In a preferred aspect of the present disclosure, the low-viscosity and the high viscosity base stocks are used in the form of a base stock blend that comprises from 5 to 95 wt. % of the low-viscosity base stock and from 5 to 95 wt. % of the high-viscosity base stock. Preferred ranges include from 10 to 90 wt. % of the low-viscosity base stock and from 10 to 90 wt. % of the high-viscosity base stock. The base stock blend is most usually used in the engine or other mechanical component oil lubricant composition from 15 to 85 wt. % of the low-viscosity base stock and from 15 to 85 wt. % of the high-viscosity base stock, preferably from 20 to 80 wt. % of the low-viscosity base stock and from 20 to 80 wt. % of the high-viscosity base stock, and more preferably from 25 to 75 wt. % of the low-viscosity base stock and from 25 to 75 wt. % of the high-viscosity base stock.

In a first preferred aspect of the present disclosure, the low-viscosity base stock of the present disclosure is used in the engine or other mechanical component oil lubricant composition in an amount ranging from about 50 to about 99 weight percent, preferably from about 70 to about 95 weight percent, and more preferably from about 85 to about 95 weight percent, based on the total weight of the composition, or for instance as the sole base oil. In a second preferred aspect of the present disclosure, the high-viscosity base stock of the present disclosure is used in the engine or other mechanical component oil lubricant composition in an amount ranging from about 50 to about 99 weight percent, preferably from about 70 to about 95 weight percent, and more preferably from about 85 to about 95 weight percent, based on the total weight of the composition, or for instance as the sole base oil.

A hydrocracking process for lubes can be used to produce the compositionally advantaged base stocks with superior low temperature and oxidation performance of this disclosure. A feed stock (i.e., a vacuum gas oil feed stock having a solvent dewaxed oil feed viscosity index of from about 20 to about 45) is processed through a first stage which is primarily a hydrotreating unit which boosts viscosity index (VI) and removes sulfur and nitrogen. This is followed by a stripping section where lower boiling molecules are removed. The heavier boiling fraction then enters a second stage where hydrocracking, dewaxing, and hydrofinishing are done. This combination of feed stock and process approaches produces a base stock with unique compositional characteristics. These unique compositional characteristics are observed in both the lower and higher viscosity base stocks produced.

The lubricating oil base stocks can be produced by processing a feed stock (i.e., a vacuum gas oil feed stock (i.e., a vacuum gas oil feed stock having a solvent dewaxed oil feed viscosity index of from about 20 to about 45) in the hydrocracking process to hit conventional VI targets for the low viscosity cut which yields the low viscosity product with unique compositional characteristics as compared with conventionally processed low viscosity base stocks. The lubricating oil base stock composition can be determined using a combination of advanced analytical techniques including gas chromatography mass spectrometry (GCMS), supercritical fluid chromatography (SFC), carbon-13 nuclear magnetic resonance (13C NMR), proton nuclear magnetic resonance (proton-NMR), and differential scanning calorimetry (DSC). Examples of Group II low viscosity lubricating oil base stocks according to an embodiment of this disclosure and having a kinematic viscosity at 100° C. in the range of 4-6 cSt are described in FIG. 9. Kinematic viscosity of lubricating oils and lubricating base stocks are measured according to ASTM Test Method D445. For reference, the low viscosity lubricating oil base stocks of this disclosure are compared with typical Group II low viscosity base stocks having the same viscosity range.

The processed high viscosity product from the above described process can also show the unique compositional characteristics described herein. Examples of such Group II high viscosity lubricating oil base stocks having kinematic viscosity at 100° C. in the range of 10-14 cSt are described in FIG. 10. For reference, the high viscosity lubricating oil base stocks of this disclosure are compared with typical Group II high viscosity base stocks having the same viscosity range.

One option for processing a heavier feed, such as a heavy distillate or gas oil type feed, is to use hydrocracking to convert a portion of the feed. Portions of the feed that are converted below a specified boiling point, such as a 700° F. (371° C.) portion that can be used for naphtha and diesel fuel products, while the remaining unconverted portions can be used as lubricant oil base stocks.

Improvements in diesel and/or lube base stock yield can be based in part on alternative configurations that are made possible by use of a dewaxing catalyst. For example, zeolite Y based hydrocracking catalysts are selective for cracking of cyclic and/or branched hydrocarbons. Paraffinic molecules with little or no branching may require severe hydrocracking conditions in order to achieve desired levels of conversion. This can result in overcracking of the cyclic and/or more heavily branched molecules in a feed. A catalytic dewaxing process can increase the branching of paraffinic molecules. This can increase the ability of a subsequent hydrocracking stage to convert the paraffinic molecules with increased numbers of branches to lower boiling point species.

In various embodiments, a dewaxing catalyst can be selected that is suitable for use in a sweet or sour environment while minimizing conversion of higher boiling molecules to naphtha and other less valuable species. The dewaxing catalyst can be used as part of an integrated process in a first stage that includes an initial hydrotreatment of the feed, hydrocracking of the hydrotreated feed, and dewaxing of the effluent from the hydrocracking, and an optional final hydrotreatment.

Alternatively, the dewaxing stage can be performed on the hydrotreated feed prior to hydrocracking. Optionally, the hydrocracking stage can be omitted. The treated feed can then be fractionated to separate out the portions of the feed that boil below a specified temperature, such as below 700° F. (371° C.). A second stage can then be used to process the unconverted bottoms from the fractionator. The bottoms fraction can be hydrocracked for further conversion, optionally hydrofinished, and optionally dewaxed.

In a conventional scheme, any catalytic dewaxing and/or hydroisomerization is performed in a separate reactor. This is due to the fact conventional catalysts are poisoned by the heteroatom contaminants (such as $H_2S$ $NH_3$, organic sulfur and/or organic nitrogen) typically present in the hydrocracked effluent. Thus, in a conventional scheme, a separation step is used to first decrease the amount of the heteroatom contaminants. Because a distillation also needs to be performed to separate various cuts from the hydrocracker effluent, the separation may be performed at the same time as distillation, and therefore prior to dewaxing.

In various embodiments, a layer of dewaxing catalyst can be included after a hydrotreating and/or hydrocracking step in the first stage, without the need for a separation stage. By using a contaminant tolerant catalyst, a mild dewaxing step can be performed on the entire hydrotreated, hydrocracked, or hydrotreated and hydrocracked effluent. This means that all molecules present in the effluent are exposed to mild dewaxing. This mild dewaxing will modify the boiling point of longer chain molecules, thus allowing molecules that would normally exit a distillation step as bottoms to be converted to molecules suitable for lubricant base stock. Similarly, some molecules suitable for lubricant base stock will be converted to diesel range molecules.

By having a dewaxing step in the first sour stage, the cold flow properties of the effluent from the first stage can be improved. This can allow a first diesel product to be generated from the fractionation after the first stage. Producing a diesel product from the fractionation after the first stage can provide one or more advantages. This can avoid further exposure of the first diesel product to hydrocracking, and therefore reduces the amount of naphtha generated relative to diesel. Removing a diesel product from the fractionator after the first stage also reduces the volume of effluent that is processed in the second or later stages. Still another advantage can be that the bottoms product from the first stage has an improved quality relative to a first stage without dewaxing functionality. For example, the bottoms fraction used as the input for the second stage can have improved cold flow properties. This can reduce the severity needed in the second stage to achieve a desired product specification.

The second stage can be configured in a variety of ways. One option can be to emphasize diesel production. In this type of option, a portion of the unconverted bottoms from the second stage can be recycled to the second stage. This can optionally be done to extinction, to maximize diesel production. Alternatively, the second stage can be configured to produce at least some lubricant base stock from the bottoms.

Still another advantage can be the flexibility provided by some embodiments. Including a dewaxing capability in both the first stage and the second stage can allow the process conditions to be selected based on desired products, as opposed to selecting conditions to protect catalysts from potential poisoning.

The dewaxing catalysts used according to the disclosure can provide an activity advantage relative to conventional dewaxing catalysts in the presence of sulfur feeds. In the context of dewaxing, a sulfur feed can represent a feed containing at least 100 ppm by weight of sulfur, or at least 1000 ppm by weight of sulfur, or at least 2000 ppm by weight of sulfur, or at least 4000 ppm by weight of sulfur, or at least 40,000 ppm by weight of sulfur. The feed and hydrogen gas mixture can include greater than 1,000 ppm by weight of sulfur or more, or 5,000 ppm by weight of sulfur or more, or 15,000 ppm by weight of sulfur or more. In yet another embodiment, the sulfur may be present in the gas only, the liquid only or both. For the present disclosure, these sulfur levels are defined as the total combined sulfur in liquid and gas forms fed to the dewaxing stage in parts per million (ppm) by weight on the hydrotreated feed stock basis.

This advantage can be achieved by the use of a catalyst comprising a 10-member ring pore, one-dimensional zeolite in combination with a low surface area metal oxide refractory binder, both of which are selected to obtain a high ratio of micropore surface area to total surface area. Alternatively, the zeolite has a low silica to alumina ratio. As another alternative, the catalyst can comprise an unbound 10-member ring pore, one-dimensional zeolite. The dewaxing catalyst can further include a metal hydrogenation function, such as a Group VI or Group VIII metal, and preferably a Group VIII noble metal. Preferably, the dewaxing catalyst is a one-dimensional 10-member ring pore catalyst, such as ZSM-48 or ZSM-23.

The external surface area and the micropore surface area refer to one way of characterizing the total surface area of a catalyst. These surface areas are calculated based on analysis of nitrogen porosimetry data using the BET method for surface area measurement. See, for example, Johnson, M. F. L., Jour. Catal., 52, 425 (1978). The micropore surface area refers to surface area due to the unidimensional pores of the zeolite in the dewaxing catalyst. Only the zeolite in a catalyst will contribute to this portion of the surface area. The external surface area can be due to either zeolite or binder within a catalyst.

The process configurations of the instant disclosure produce high viscosity, high quality Group II base stocks that have unique compositional characteristics with respect to prior art Group II base stocks. The compositional advantage may be derived from the saturates and the naphthenoaromatic portions of the composition. Additionally, the compositional advantage affords lower than expected Noack volatilities for the high viscosity materials as compared to applicable references, particularly at relatively lower pour point.

The base stocks of the instant disclosure yield a kinematic viscosity at 100° C. of greater than or equal to 2 cSt, or greater than or equal to 4 cSt, or greater than or equal to 6 cSt, or greater than or equal to 8 cSt, or greater than or equal to 10 cSt, or greater than or equal to 12 cSt, or greater than or equal to 14 cSt. This permits the inventive Group II base stocks to be used in host of new lubricant applications requiring higher viscosity than what was attainable with prior art Group II base stocks. Additionally, at a kinematic viscosity at 100° C. of greater than 11 cSt, lower Noack volatility can be achieved over that obtained by conventional catalytic processing without having to take a narrower cut during fractionation.

The base stocks of the instant disclosure are produced by the integrated hydrocracking and dewaxing process disclosed herein. For the integrated hydrocracking and dewaxing process disclosed herein, the acidic sites catalyze dehydrogenation, cracking, isomerization, and dealkylation while the metal sites promote hydrogenation, hydrogenolysis, and isomerization. A system dominated by acid function results in excess cracking while a catalytic system with high concentration of metals leads to mainly hydrogenation. Noble metals supported on acidic oxides are the most active catalysts for selective ring opening, but these catalysts are sensitive to poisoning by sulfur compounds in petroleum feed stocks. This leads to a more favorable balance of base stock molecules. In particular, the ring opening reactions potentially have the highest selectivity increase relative to the base processing which improves some lubes quality measures (e.g., VI). However, this also yields a viscosity retention advantage that is not expected to occur with ring opening. This viscosity increase that occurs for Group II base stocks produced by the integrated hydrocracking and dewaxing process disclosed herein is surprising and unexpected.

In addition, the base stocks yield improvements in finished lubricant properties, including, but not limited to, viscosity index, blendability as measured by Noack volatility/CCS viscosity (Cold Crank Simulator viscosity), volatility as measured by Noack volatility, low temperature performance as measured by pour point, oxidative stability as measured by RPVOT, deposit formation and toxicity. More particularly, lubricant compositions including the inventive Group II base stocks yield a viscosity Index of from 80 to 120, or 90 to 120, or 100 to 120, or 90 to 110. The oxidative stability as measured by the RPVOT test (ASTM 11)2272 test for the time in minutes to a 25.4 psi pressure drop) of the lubricant compositions including the inventive Group II base stocks ranges from 820 to 1000, or 875 to 1000, or 875 to 950 minutes. The Noack volatility as measured by ASTM B3952 or D5800, Method B test of the Group II base stocks for a $KV_{100}$ viscosity of at least 10 cSt is less than 4, or less than 3, or less than 2, or less than 1, or less than 0.5 wt. %. The pour point as measured by ASTM B3983 or D5950-1 test of the lubricant compositions including the inventive Group II base stocks ranges from −10° C. to −45° C., or less than −12, or less than −15, or less than −20, or less than −30, or less than −40° C.

The base stocks of the instant disclosure produced by the integrated hydrocracking and dewaxing process disclosed herein have a novel compositional structure as measured by the distribution of naphthenes and naphthenoaromatic species, which yields the increased viscosity and other beneficial properties.

The unique compositional character of a 4 to 6 or a 5 to 6 or a 5 to 7 cSt ($KV_{100}$) lube base stock of the instant disclosure may also be quantified by UV absorptivity. For base stocks with a kinematic viscosity in the range 4-6 cSt, or preferably 5-6 cSt at 100° C., the amount and distribution of aromatics, as determined by ultra violet (UV) spectroscopy, is an absorptivity between 280 and 320 nm of less than about 0.020 l/gm-cm, preferably less than about 0.015 l/gm-cm.

In an embodiment, for base stocks with a kinematic viscosity in the range 4-6 cSt at 100° C., or 5-6 cSt at 100° C., the amount and distribution of aromatics, as determined by ultra violet (UV) spectroscopy, is:

absorptivity @ 226 nm of less than about 0.16 l/g-cm;
absorptivity @ 275 nm of less than about 0.014 l/g-cm;
absorptivity @ 302 nm of less than about 0.006 l/g-cm;
absorptivity @ 310 nm of less than about 0.007 l/g-cm;
absorptivity @ 325 nm of less than about 0.0018 l/g-cm; and
absorptivity @ 339 nm of less than about 0.0014 l/g-cm;
absorptivity @ 400 nm of less than about 0.00015 l/g-cm.

In another embodiment, for base stocks with a kinematic viscosity in the range 4-6 cSt at 100° C., or 5-6 cSt at 100° C., the amount and distribution of aromatics, as determined by ultra violet (UV) spectroscopy, is:

absorptivity @ 226 nm of less than about 0.16 l/g-cm;
absorptivity @ 254 nm of less than about 0.008 l/g-cm;
absorptivity @ 275 nm of less than about 0.014 l/g-cm;
absorptivity @ 302 nm of less than about 0.006 l/g-cm;
absorptivity @ 310 nm of less than about 0.007 l/g-cm;
absorptivity @ 325 nm of less than about 0.0018 l/g-cm;
absorptivity @ 339 nm of less than about 0.0014 l/g-cm; and
absorptivity @ 400 nm of less than about 0.00015 l/g-cm.

In yet another embodiment, for base stocks with a kinematic viscosity in the range 4-6 cSt at 100° C., or 5-6 cSt at 100° C., the amount and distribution of aromatics, as determined by ultra violet (UV) spectroscopy, is:

absorptivity @ 226 nm of less than about 0.15 l/g-cm;
absorptivity @ 254 nm of less than about 0.007 l/g-cm;
absorptivity @ 275 nm of less than about 0.013 l/g-cm;
absorptivity @ 302 nm of less than about 0.005 l/g-cm;
absorptivity @ 310 nm of less than about 0.006 l/g-cm;
absorptivity @ 325 nm of less than about 0.0017 l/g-cm;
absorptivity @ 339 nm of less than about 0.0013 l/g-cm; and
absorptivity @ 400 nm of less than about 0.00014 l/g-cm.

In still another embodiment, for base stocks with a kinematic viscosity in the range 4-6 cSt at 100° C., or 5-6 cSt at 100° C., the amount and distribution of aromatics, as determined by ultra violet (UV) spectroscopy, is:

absorptivity @ 226 nm of less than about 0.14 l/g-cm;
absorptivity @ 254 nm of less than about 0.006 l/g-cm;
absorptivity @ 275 nm of less than about 0.012 l/g-cm;
absorptivity @ 302 nm of less than about 0.004 l/g-cm;
absorptivity @ 310 nm of less than about 0.005 l/g-cm;
absorptivity @ 325 nm of less than about 0.0016 l/g-cm;
absorptivity @ 339 nm of less than about 0.0012 l/g-cm; and
absorptivity @ 400 nm of less than about 0.00013 l/g-cm.

The unique compositional character of a 6 to 14 cSt ($KV_{100}$) lube base stock of the instant disclosure may also be quantified by UV absorptivity. For base stocks with a kinematic viscosity in the range 6-14 (preferably 10-14) cSt at 100° C., or 10-13 cSt at 100° C., the amount and distribution of aromatics, as determined by ultra violet (UV) spectroscopy, is an absorptivity between 280 and 320 nm of less than about 0.020 l/gm-cm, preferably less than about 0.015 l/gm-cm.

In an embodiment, for base stocks with a kinematic viscosity in the range 6-12 (preferably 10-14) cSt at 100° C., or 10-13 cSt at 100° C., the amount and distribution of aromatics, as determined by ultra violet (UV) spectroscopy, is:

absorptivity @ 226 nm of less than about 0.12 l/g-cm;
absorptivity @ 275 nm of less than about 0.012 l/g-cm;
absorptivity @ 302 nm of less than about 0.014 l/g-cm;
absorptivity @ 310 nm of less than about 0.018 l/g-cm; and
absorptivity @ 325 nm of less than about 0.009 l/g-cm.

In another embodiment, for base stocks with a kinematic viscosity in the range 6-12 (preferably 10-14) cSt at 100° C., or 10-13 cSt at 100° C., the amount and distribution of aromatics, as determined by ultra violet (UV) spectroscopy, is:

absorptivity @ 226 nm of less than about 0.12 l/g-cm;
absorptivity @ 254 nm of less than about 0.009 l/g-cm;
absorptivity @ 275 nm of less than about 0.012 l/g-cm;
absorptivity @ 302 nm of less than about 0.014 l/g-cm;
absorptivity @ 310 nm of less than about 0.018 l/g-cm;
absorptivity @ 325 nm of less than about 0.009 l/g-cm;
absorptivity @ 339 nm of less than about 0.007 l/g-cm; and
absorptivity @ 400 nm of less than about 0.0008 l/g-cm;

In yet another embodiment, for base stocks with a kinematic viscosity in the range 6-12 (preferably 10-14) cSt at 100° C., or 10-13 cSt at 100° C., the amount and distribution of aromatics, as determined by ultra violet (UV) spectroscopy, is:

absorptivity @ 226 nm of less than about 0.11 l/g-cm;
absorptivity @ 254 nm of less than about 0.008 l/g-cm;
absorptivity @ 275 nm of less than about 0.011 l/g-cm;
absorptivity @ 302 nm of less than about 0.013 l/g-cm;
absorptivity @ 310 nm of less than about 0.017 l/g-cm;
absorptivity @ 325 nm of less than about 0.008 l/g-cm;
absorptivity @ 339 nm of less than about 0.006 l/g-cm; and
absorptivity @ 400 nm of less than about 0.0007 l/g-cm.

In still another embodiment, for base stocks with a kinematic viscosity in the range 6-14 (preferably 10-14) cSt at 100° C., or 10-13 cSt at 100° C., the amount and distribution of aromatics, as determined by ultra violet (UV) spectroscopy, is:

absorptivity @ 226 nm of less than about 0.10 l/g-cm;
absorptivity @ 254 nm of less than about 0.007 l/g-cm;
absorptivity @ 275 nm of less than about 0.010 l/g-cm;
absorptivity @ 302 nm of less than about 0.012 l/g-cm;
absorptivity @ 310 nm of less than about 0.016 l/g-cm;
absorptivity @ 325 nm of less than about 0.007 l/g-cm;
absorptivity @ 339 nm of less than about 0.005 l/g-cm; and
absorptivity @ 400 nm of less than about 0.0006 l/g-cm.

The base stocks of the instant disclosure produced by the integrated hydrocracking and dewaxing process disclosed herein also have low aromatics prior to hydrofinishing. As measured by the STAR 7 test method as described in the U.S. Pat. No. 8,114,678, the disclosure of which is incorporated herein by reference), the saturates are greater than or equal to 90 wt. %, or greater than or equal to 95 wt. %, or greater than or equal to 97 wt. %, while the aromatics are less than or equal to 10 wt. %, or less than or equal to 5 wt. %, less than or equal to 3 wt. %.

A wide range of petroleum and chemical feed stocks can be hydroprocessed in accordance with the present disclosure. Suitable feed stocks include whole and reduced petroleum crudes, atmospheric and vacuum residua, propane deasphalted residua, e.g., brightstock, cycle oils (light cycle), FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials. Typical feeds would include, for example, vacuum gas oils boiling up to about 593° C. (about 1100° F.) and usually in the range of about 350° C. to about 500°. (about 660° F. to about 935° F.) and, in this case, the proportion of diesel fuel produced is correspondingly greater. In some embodiments, the sulfur content of the feed can be at least 100 ppm by weight of sulfur, or at least 1000 ppm by weight of sulfur, or at least 2000 ppm by weight of sulfur, or at least 4000 ppm by weight of sulfur, or at least 40,000 ppm by weight of sulfur.

Particularly preferable feed stock components useful in the process of this disclosure include vacuum gas oil feed stocks (e.g., medium vacuum gas oil feeds (MVGO)) having a solvent dewaxed oil feed viscosity index of from about 20 to about 45, preferably from about 25 to about 40, and more preferably from about 30 to about 35.

It is noted that for stages that are tolerant of a sour processing environment, a portion of the sulfur in a processing stage can be sulfur containing in a hydrogen treat gas stream. This can allow, for example, an effluent hydrogen stream from a hydroprocessing reaction that contains $H_2S$ as an impurity to be used as a hydrogen input to a sour environment process without removal of some or all of the $H_2S$. The hydrogen stream containing $H_2S$ as an impurity can be a partially cleaned recycled hydrogen stream from one of the stages of a process according to the disclosure, or the hydrogen stream can be from another refinery process.

As used herein, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. It is noted that a "bed" of catalyst can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

A variety of process flow schemes are available according to various embodiments of the disclosure. In one example, a feed can initially by hydrotreated by exposing the feed to one or more beds of hydrotreatment catalyst. The entire hydrotreated feed, without separation, can then be hydrocracked in the presence of one or more beds of hydrocracking catalyst. The entire hydrotreated, hydrocracked feed, without separation, can then be dewaxed in the presence of one or more beds of dewaxing catalyst. An optional second hydrotreatment catalyst bed can also be included after either the hydrocracking or the dewaxing processes. By performing hydrotreating, hydrocracking, and dewaxing processes without an intermediate separation, the equipment required to perform these processes can be included in a single stage.

In another example, a feed can initially by hydrotreated by exposing the feed to one or more beds of hydrotreatment catalyst. The entire hydrotreated feed, without separation, can then be dewaxed in the presence of one or more beds of dewaxing catalyst. The entire hydrotreated, dewaxed feed, without separation, can then optionally be hydrocracked in the presence of one or more beds of hydrocracking catalyst. An optional second hydrotreatment catalyst bed can also be included. By performing hydrotreating, dewaxing, and hydrocracking processes without an intermediate separation, the equipment required to perform these processes can be included in a single stage.

After the hydrotreating, dewaxing, and/or hydrocracking in a sour environment, the hydroprocessed feed can be fractionated into a variety of products. One option for fractionation can be to separate the hydroprocessed feed into portions boiling above and below a desired conversion temperature, such as 700° F. (371° C.). In this option, the portion boiling below 371° C. corresponds to a portion containing naphtha boiling range product, diesel boiling range product, hydrocarbons lighter than a naphtha boiling range product, and contaminant gases generated during hydroprocessing such as $H_2S$ and $NH_3$. Optionally, one or more of these various product streams can be separated out as a distinct product by the fractionation, or separation of these products from a portion boiling below 371° C. can occur in a later fractionation step. Optionally, the portion boiling below 371° C. can be fractionated to also include a kerosene product.

The portion boiling above 371° C. corresponds to a bottoms fraction. This bottoms fraction can be passed into a second hydroprocessing stage that includes one or more types of hydroprocessing catalysts. The second stage can include one or more beds of a hydrocracking catalyst, one or more beds of a dewaxing catalyst, and optionally one or more beds of a hydrofinishing or aromatic saturation catalyst. The reaction conditions for hydroprocessing in the second stage can be the same as or different from the conditions used in the first stage. Because of the hydrotreatment processes in the first stage and the fractionation, the sulfur content of the bottoms fraction, on a combined gas and liquid sulfur basis, can be 1000 wppm or less, or about 500 wppm or less, or about 100 wpm or less, or about 50 wpm or less, or about 10 wppm or less.

Still another option can be to include one or more beds of hydrofinishing or aromatic saturation catalyst in a separate third stage and/or reactor. In the discussion below, a reference to hydrofinishing is understood to refer to either hydrofinishing or aromatic saturation, or to having separate hydrofinishing and aromatic saturation processes. In situations where a hydrofinishing process is desirable for reducing the amount of aromatics in a feed, it can be desirable to operate the hydrofinishing process at a temperature that is colder than the temperature in the prior hydroprocessing stages. For example, it may be desirable to operate a dewaxing process at a temperature above 300° C. while operating a hydrofinishing process at a temperature below 280° C. One way to facilitate having a temperature difference between a dewaxing and/or hydrocracking process and a subsequent hydrofinishing process is to house the catalyst beds in separate reactors. A hydrofinishing or aromatic saturation process can be included either before or after fractionation of a hydroprocessed feed.

FIG. 1 shows an example of a general reaction system that utilizes two reaction or hydrotreating stages suitable for use in various embodiments of the disclosure. In FIG. 1, a reaction system is shown that includes a first reaction or hydrotreating stage (R1)\ and a second reaction or hydrotreating stage (R2). Both the first reaction stage (R1) and second reaction stage (R2) are represented in FIG. 1 as single reactors. Alternatively, any convenient number of reactors can be used for the first stage (R1) and/or the second stage (R2). The effluent from second reaction or hydrotreating stage (R2) is passed into a first atmospheric fractionator or separation stage. The first separation stage can produce at least a diesel product fraction, jet product fraction, and a naphtha fraction. Optionally the first separation stage can also produce a gas phase fraction that can include both contaminants such as $H_2S$ or $NH_3$ as well as low boiling point species such as $C_1$-$C_4$ hydrocarbons. Further, the first separation stage can optionally produce a kerosene fraction.

The bottoms fraction from the first separation stage is used as input to the first hydrocracking stage, along with a second hydrogen stream. The bottoms fraction from the first separation stage is hydrocracked in this stage. The bottoms fraction from the first hydrocracking stage is used as input to the second dewaxing stage. The bottoms fraction from the first hydrocracking stage is hydrocracked in this stage. The bottoms from the dewaxing stage is used as input to the hydrofinishing stage. The bottoms fraction from the dewaxing stage is further hydrotreated in this stage. At least a portion of the effluent from the hydrotreating stage can be sent to a second atmospheric fractionator or separation stage for production of one or more products, such as a second naphtha product and a second jet/diesel product. The bottoms fraction from the second separation stage is used as input to a vacuum fractionator or separation stage for production of one or more products, such as a third diesel product, a light lube, and a heavy lube.

Process conditions (e.g., temperature, pressure, contact time, and the like) for hydrotreating, fractionating, hydrocracking and dewaxing can vary and any suitable combination of such conditions can be employed as described herein for processing schemes of this disclosure. Any suitable catalysts can be employed for hydrotreating, fractionating, hydrocracking and dewaxing as described herein for processing schemes of this disclosure.

Figure 2:
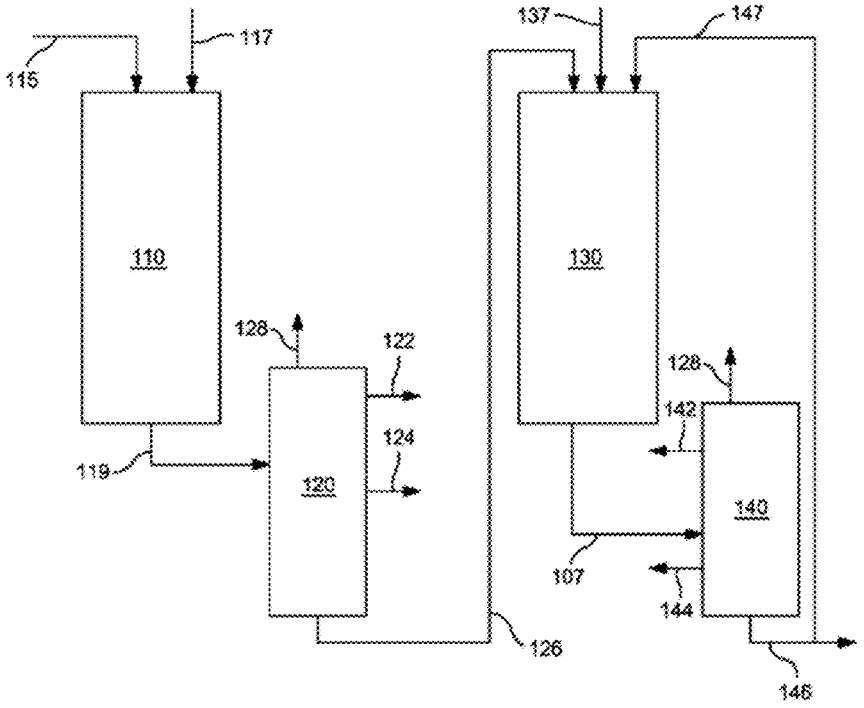
FIG. 2 schematically shows an example of a multi-stage reaction system according to an embodiment of the disclosure.

FIG. 2 shows another example of a general reaction system that utilizes two reaction stages suitable for use in various embodiments of the disclosure. In FIG. 2, a reaction system is shown that includes a first reaction stage 110, a separation stage 120, and a second reaction stage 130. Both the first reaction stage 110 and second reaction stage 130 are represented in FIG. 2 as single reactors. Alternatively, any convenient number of reactors can be used for the first stage 110 and/or the second stage 130. The separation stage 120 is a stage capable of separating a diesel fuel product from the effluent generated by the first stage.

A suitable feedstock 115 is introduced into first reaction stage 110 along with a hydrogen-containing stream 117. The feedstock is hydroprocessed in the presence of one or more catalyst beds under effective conditions. The effluent 119 from first reaction stage 110 is passed into separation stage 120. The separation stage 120 can produce at least a diesel product fraction 124, a bottoms fraction 126, and gas phase fraction 128. The gas phase fraction can include both contaminants such as $H_2S$ or $NH_3$ as well as low boiling point species such as $C_1$-$C_4$ hydrocarbons. Optionally, the separation stage 120 can also produce a naphtha fraction 122 and/or a kerosene fraction (not shown). The bottoms fraction 126 from the separation stage is used as input to the second hydroprocessing stage 130, along with a second hydrogen stream 137. The bottoms fraction is hydroprocessed in second stage 130. At least a portion of the effluent from second stage 130 can be sent to a fractionator 140 for production of one or more products, such as a second naphtha product 142, a second diesel product 144, or a lubricant base oil product 146. Another portion of the bottoms from the fractionator 140 can optionally be recycled back 147 to second stage 130.

Figure 5:
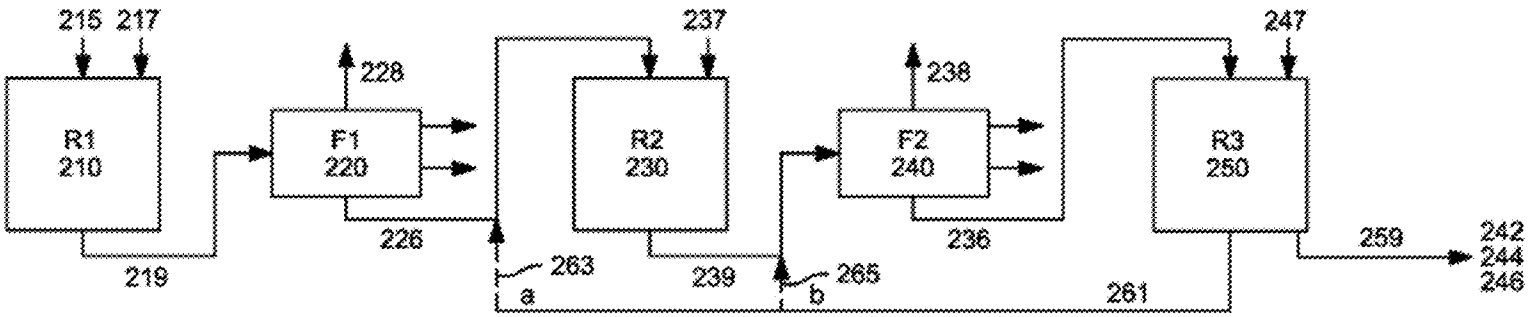
FIG. 5 schematically shows an example of a three-stage reaction system according to an alternative embodiment of the disclosure.

FIG. 5 shows an example of a general reaction system that utilizes three reaction stages suitable for use in alternative embodiments of the disclosure. In FIG. 5, a reaction system is shown that includes a first reaction stage 210, a first fractionation stage 220, a second reaction stage 230, a second fractionation stage 240, and a third reaction stage 250. The first reaction stage 210, second reaction stage 230 and third reaction stage 250 are represented in FIG. 5 as single reactors. Alternatively, any convenient number of reactors can be used for the first stage 210, second stage 230 and/or third stage 250. A suitable feedstock 215 is introduced into first reaction stage 210 along with a hydrogen-containing stream 217. The feedstock is hydroprocessed in the presence of one or more catalyst beds under effective conditions. In one form, the first reaction stage 210 may be a conventional hydrotreating reactor operating at effective hydrotreating conditions. The first reaction stage effluent 219 is fed to a first fractionator 220. The first fractionator 220 is a stage capable of removing a first fuel/diesel range material 228 and a first lube range material 226. The first lube range material 226 from the fractionator is used as input to the second reaction stage/hydroprocessing stage 230 along with a second hydrogen stream 237. The first lube range material 226 is hydroprocessed in the second reaction stage 230.

In one form, the second reaction stage 230 may be a hydrodewaxing reactor loaded with a dewaxing catalyst and operated under effective dewaxing conditions. The second effluent 239 from the second reaction stage 230 is passed into a second fractionator 240. The second fractionator 240 can produce a second fuel/diesel range material 238 and a second lube range material 236. The second lube range material 236 from the second fractionator may be used as input to the third reaction stage/hydroprocessing stage 250, along with a third hydrogen stream 247. The second lube range material 236 is hydroprocessed in the third reaction stage 250.

In one form, the third reaction stage 230 may be a hydrocracking reactor loaded with a hydrocracking catalyst. At least a portion of the effluent 259 from third reaction stage 250 can then be sent to a fractionator (not shown) for production of one or more products, such as a naphtha product 242, a fuel/diesel product 244, or a lubricant base oil product 246. Another portion of the bottoms 261 from the third reaction stage 250 can optionally be recycled back to either the second reaction stage 230 via recycle stream 263 or the second fractionation stage 240 via recycle stream 265 or a combination thereof. Recycle stream 263 is utilized when the product from third reaction stage 250 does not meet cold flow property specifications of the diesel product 244 or lubricant base oil product 246 and further dewaxing is necessary to meet the specifications. Recycle stream 265 is utilized when the product from third reaction stage 250 does not need further dewaxing to meet the cold flow property specifications of the diesel product 244 or lubricant base oil product 246.

In another form, the process configuration of FIG. 5 may further include a hydrofinishing reactor after the third reaction stage and prior to the fractionator. The hydrofinishing reactor may be loading with a hydrofinishing catalyst and run at effective reaction conditions.

The process configuration of FIG. 5 maximizes the fuel/diesel yield in a 3-stage hydrocracker. The configuration produces a diesel product possessing superior cold flow properties. In contrast with the current state of the art, the diesel product coming from a hydrocracker may not produce diesel with ideal cold flow properties and would have to be subsequently dewaxed to improve product quality. With the process configuration of FIG. 5, all the diesel product would be sufficiently dewaxed before exiting the system to meet cold flow property requirements.

Figure 6:
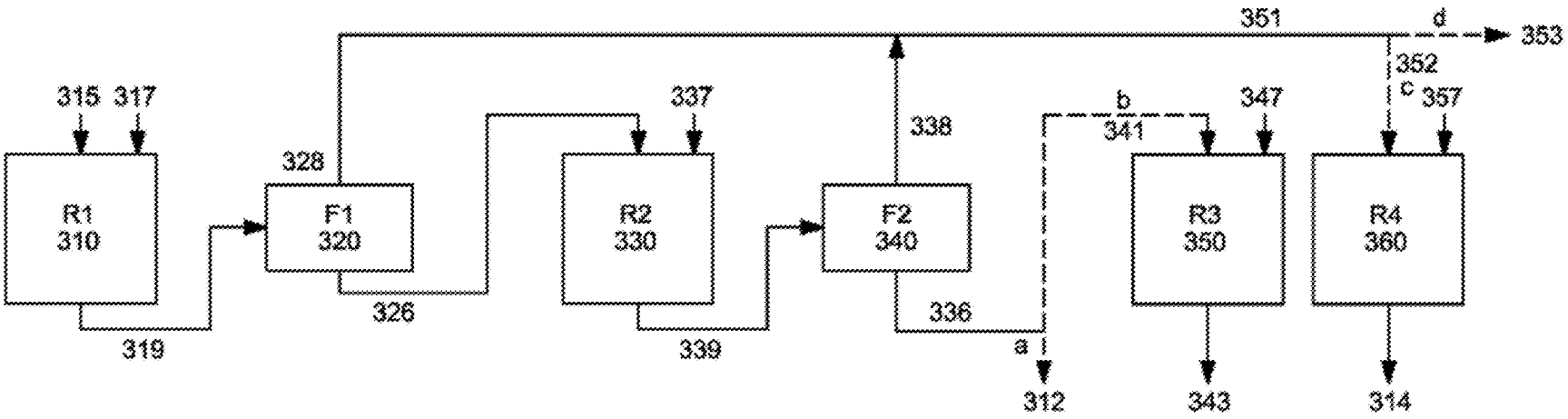
FIG. 6 schematically shows an example of a four-stage reaction system according to an alternative embodiment of the disclosure.

FIG. 6 shows an example of a general reaction system that utilizes four reaction stages suitable for use in alternative embodiments of the disclosure. In FIG. 6, a reaction system is shown that includes a first reaction stage 310, a first fractionation stage 320, a second reaction stage 330, a second fractionation stage 340, a third reaction stage 350, and an optional fourth reaction stage 360. The first reaction stage 310, second reaction stage 330, a third reaction stage 350 and a fourth reaction stage 360 are represented in FIG. 6 as single reactors. Alternatively, any convenient number of reactors can be used for the first stage 310, second stage 330, third stage 350 and/or fourth stage 360. A suitable feedstock 315 is introduced into first reaction stage 310 along with a hydrogen-containing stream 317. Hydrogen-containing streams may also be introduced into the second reaction stage 330, third reaction stage 350 and fourth reaction stage 360 as streams 337, 347 and 357, respectively.

The first reaction stage 310 is a hydrotreating reactor operating under effective hydrotreating conditions, but may also include optionally stacked beds with hydroisomerization and/or hydrocracking catalysts. The first reaction stage effluent 319 is fed to a first fractionator 320. The first fractionator 320 is a stage capable of removing a first fuel/diesel range material 328 and a first lube range material 326. In the second reaction stage 330, the first lube range material 326 is hydrocracked to raise the VI by cracking of naphthenes under effective hydrocracking conditions. This second reaction stage 330 serves as the primary hydrocracker for the bottoms 326 from first fractionator 320. Optionally, there may also be within the second reaction stage 330 a stacked configuration utilizing a dewaxing catalyst above or below the hydrocracking catalyst.

For maximum lube generation, the hydrocracking catalyst would be located prior to the dewaxing catalyst in the second reaction stage 330. The second reaction stage effluent 339 is fed to a second fractionator 340. The second fractionator 340 separates a second fuel/diesel range material 338 from the second lube range material 336 exiting the second reaction stage 330. The second fuel/diesel range material 338 is then combined with the first fuel/diesel range material 328 to form a combined fuel/diesel range material 351, which may be optionally passed to the fourth reaction stage 360, which is typically a hydrofinishing reactor operating at effective hydrofinishing conditions or a hydrodewaxing reactor operating at effective dewaxing conditions.

The fourth reaction stage 360 serves as a isomerization reactor to improve the cold flow properties of at least one of the first lube range material 326 and second fuel/diesel range material 338 or the combined fuel/diesel range material 351. Alternatively, either the second fuel/diesel range material 338, or the combined fuel/diesel range material 351 may bypass the fourth reaction stage 360 where no cold flow improvement is needed. In the third reaction stage 350, the reactor is used to improve the performance of the second lube range material 336. The third reaction stage 350 may include a dewaxing catalyst, an aromatic saturation catalyst or both and operates to improve the cold flow properties. The third reaction stage effluent 343 results in a third lube range material 343.

In FIG. 6, flow path 342 will be chosen if the second lube range material 336 from second fractionator 340 does not require improved lube performance through aromatic saturation and/or dewaxing by bypassing the third reaction stage 350. This configuration eliminates the third reaction stage 350. Flow path 341 will be chosen if the second lube range material 336 from second fractionator 340 does require improved lube performance through aromatic saturation and/or dewaxing by passing through the third reaction stage 350. Flow path 352 will be chosen if the combined fuel/diesel range material 351 from the first and second fractionators need improved cold flow properties through dewaxing through the fourth reaction stage 360. Finally, flow path 353 will be chosen if the combined fuel/diesel range material 351 from the first and second fractionators do not need improved cold flow properties through dewaxing through the fourth reaction stage 360. This configuration eliminates the fourth reaction stage 360.

Figure 7:
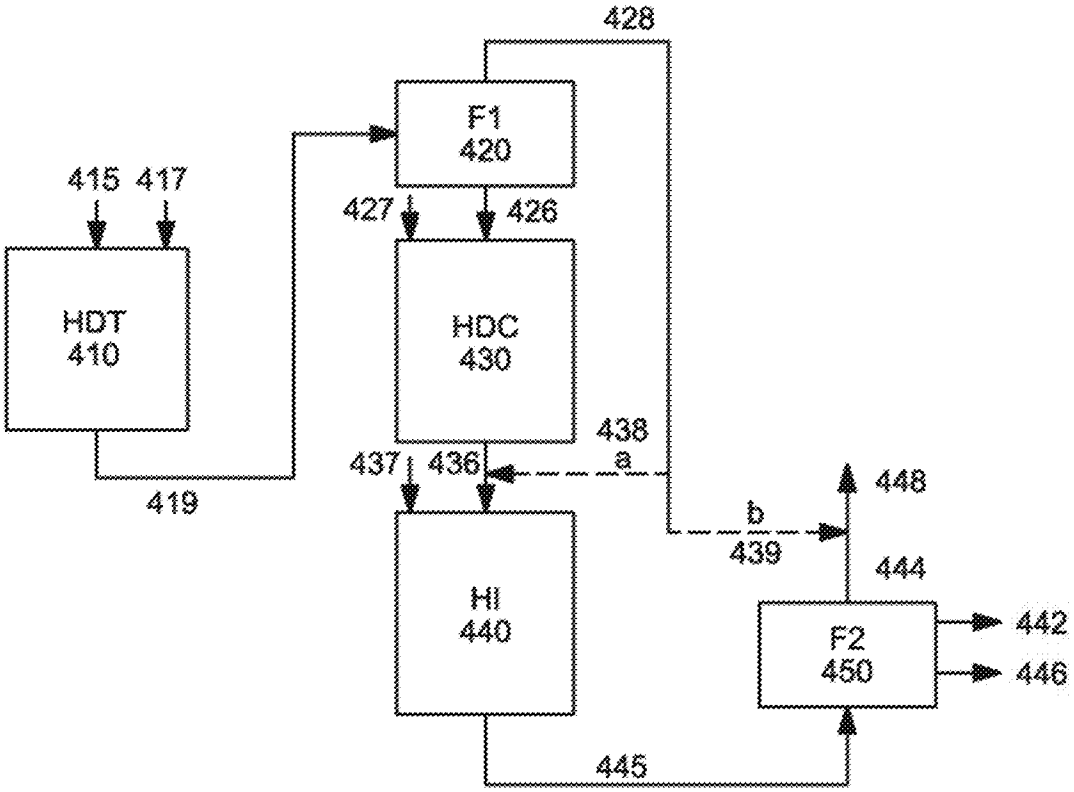
FIG. 7 schematically shows an example of a still yet another three-stage reaction system according to an alternative embodiment of the disclosure.

FIG. 7 shows an example of a general reaction system that utilizes three reaction stages suitable for use in alternative embodiments of the disclosure. In FIG. 7, a reaction system is shown that includes a first reaction stage 410, a first fractionation stage 420, a second reaction stage 430, a third reaction stage 440, and a second fractionation stage 450. The first reaction stage 410, second reaction stage 430 and third reaction stage 440 are represented in FIG. 7 as single reactors. Alternatively, any convenient number of reactors can be used for the first stage 410, second stage 430 and/or third stage 440. A suitable feedstock 415 is introduced into first reaction stage 410 along with a hydrogen-containing stream 417. The feedstock is hydroprocessed in the presence of one or more catalyst beds under effective conditions, in one form, the first reaction stage 410 may be a conventional hydrotreating reactor operating at effective hydrotreating conditions. The first reaction stage effluent 419 is fed to a first fractionator 420. The first fractionator 420 is a stage capable of removing a first fuel/diesel range material 428 and a first lube range material 426. The first lube range material 426 from the fractionator is used as input to the second reaction stage/hydroprocessing stage 430 along with a second hydrogen stream 427. The first lube range material 426 is hydroprocessed in the second reaction stage 430.

In one form, the second reaction stage 430 may be a hydrocracking reactor loaded with a hydrocracking catalyst. The second effluent 436 from the second reaction stage 430 is passed into a third reaction stage 440. In one form, the third reaction stage 440 may be a hydrodewaxing reactor with an input hydrogen containing stream 437 loaded with a dewaxing catalyst and operating under effective hydrodewaxing conditions. The effluent 445 from the third reaction stage may then be input to a second fractionator 450. The second fractionator 450 can produce a second fuel/diesel range material 444 and a second lube range material 446. The second fractionator 450 may produce one or more products, such as a naphtha and LPG product 442, a fuel/diesel product 444, or a lubricant base oil product 446. Optionally, at least a portion of the first fuel/diesel range material 428 from the first fractionator 420 may be recycled to the third reaction stage 440 via flow line 438 where an improvement in cold flow properties of the fuel/diesel product is desired. Alternatively, a portion or all of the first fuel/diesel range material 428 from first fractionator 420 may be recycled to the third reaction stage (see flow line 439). The first and second fuel/diesel range materials 439 and 444 may then be combined to form a combined fuel/diesel product 448. The reaction system of FIG. 7 is particularly suitable for coproducing diesel and lube oil with good low temperature properties while producing limited amounts of naphtha and LPG.

Figure 3:
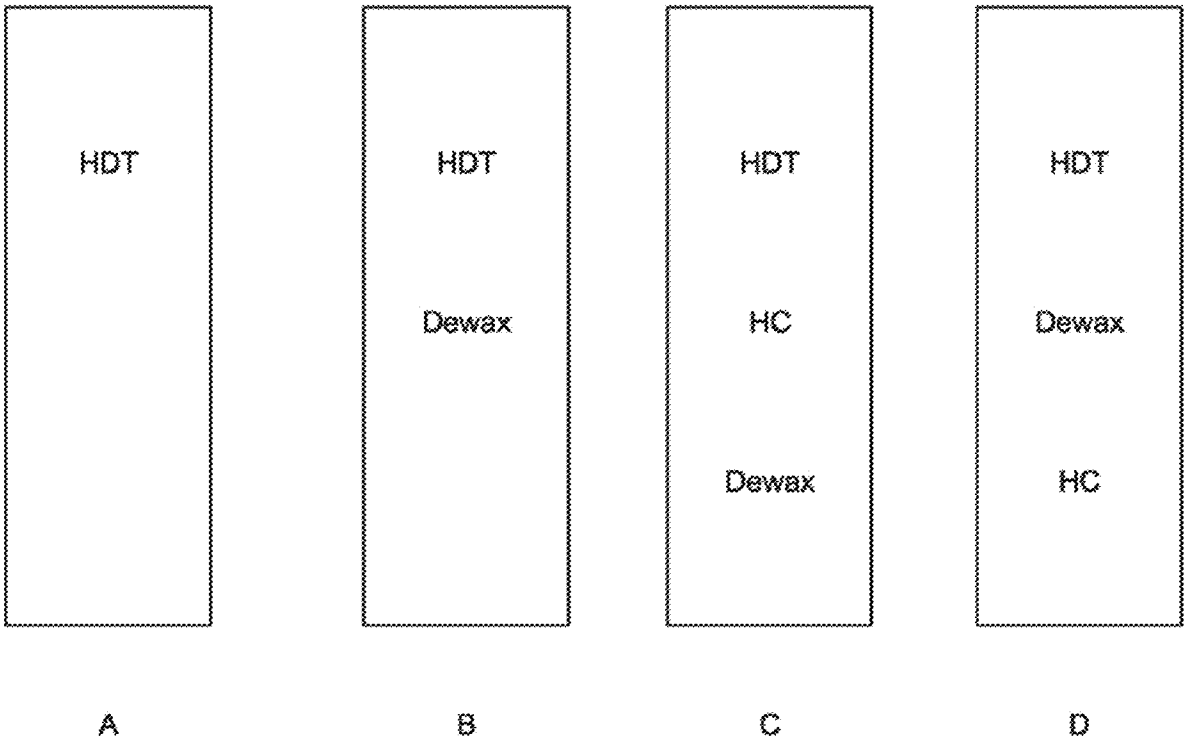
FIG. 3 schematically shows examples of catalyst configurations for a first reaction stage.

FIG. 3 shows examples of four catalyst configurations (A-D) that can be employed in a first stage under sour conditions. Configuration A shows a first reaction stage that includes hydrotreating catalyst. Configuration B shows a first reaction stage that includes beds of a hydrotreating catalyst and a dewaxing catalyst. Configuration C shows a first reaction stage that includes beds of a hydrotreating catalyst, a hydrocracking catalyst, and a dewaxing catalyst. Configuration D shows a first reaction stage that includes beds of a hydrotreating catalyst, a dewaxing catalyst, and a hydrocracking. Note that the reference here to "beds" of catalyst can include embodiments where a catalyst is provided as a portion of a physical bed within a stage.

The selection of a configuration from Configurations A, B, C, or D can be based on a desired type of product. For example, Configuration B includes a hydrotreatment catalyst and a dewaxing catalyst. A sour reaction stage based on Configuration B can be useful for producing an effluent with improved cold flow properties relative to Configuration A. A diesel fuel produced from processing in Configuration B can have an improved cloud point. The yield of diesel fuel will also be improved while reducing the amount of bottoms. The bottoms from Configuration B can also have an improved pour point. After fractionation to separate out products such as a diesel fuel product, as well as contaminant gases such as $H_2S$ and $NH_3$, the bottoms can be further processed in a second stage.

Configuration C can also provide a higher yield of diesel product as compared to Configuration A, along with an improved cloud point. Additionally, based on the presence of hydrocracking catalyst, Configuration C has benefits for producing a lube product from the bottoms portion. Relative to Configuration A, the pour point of the bottoms may be higher or lower. The dewaxing process will tend to lower the pour point of the bottoms fraction, while a hydrocracking process may tend to increase the pour point. Configuration D can provide a greater yield of diesel as compared to Configuration C, with a corresponding decrease in the amount of bottoms. In Configuration D, the dewaxing catalyst can increase the branching in the paraffinic molecules in the feed, which can increase the ability for the hydrocracking catalyst to convert the paraffinic molecules to lower boiling point species.

As an alternative, Configurations C and D can be compared to a conventional reactor containing a hydrotreating catalyst followed by a hydrocracking catalyst. Configurations C and D both can provide a diesel product with an improved cloud point relative to a convention hydrotreating/hydrocracking configuration, due to the presence of the dewaxing catalyst. The pour point for the bottoms in Configurations C and D can be lower than the bottoms for a conventional hydrotreating/hydrocracking process.

Figure 4:
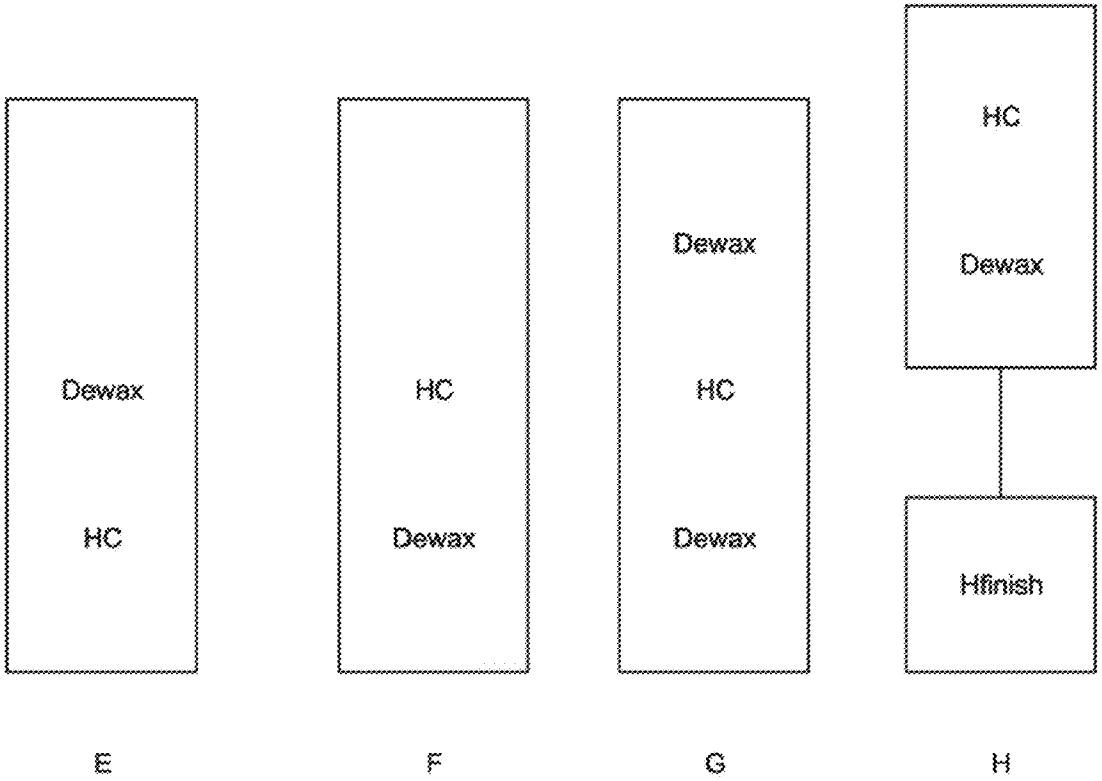
FIG. 4 schematically shows examples of catalyst configurations for a second reaction stage.

The bottoms from processing in a stage having a configuration corresponding to one of Configurations B, C, or D can then be processed in a second stage. Due to fractionation, the second stage can be a clean service stage, with a sulfur content of less than about 1000 wppm on a combined gas and liquid phase sulfur basis. FIG. 4 shows examples of catalyst configurations (E, F, G, and H) that can be employed in a second stage. Configuration E shows a second reaction stage that includes beds of dewaxing catalyst and hydrocracking catalyst. Configuration F shows a second reaction stage that includes beds of hydrocracking catalyst and dewaxing catalyst. Configuration G shows a second reaction stage that includes beds of dewaxing catalyst, hydrocracking catalyst, and more dewaxing catalyst. Note that in Configuration G, the second set of beds of dewaxing catalyst can include the same type(s) of dewaxing catalyst as the first group of beds or different type(s) of catalyst.

Optionally, a final bed of hydrofinishing catalyst could be added to any of Configurations E, F, or G. Configuration H shows this type of configuration, with beds of hydrocracking, dewaxing, and hydrofinishing catalyst. As noted above, each stage can include one or more reactors, so one option can be to house the hydrofinishing catalyst in a separate reactor from the catalysts shown for Configurations E, F, or G. This separate reactor is schematically represented in Configuration H. Note that the hydrofinishing beds can be included either before or after fractionation of the effluent from the second (or non-sour) reaction stage. As a result, hydrofinishing can be performed on a portion of the effluent from the second stage if desired.

Configurations E, F, and G can be used to make both a fuel product and a lubricant base oil product from the bottoms of the first sour stage. The yield of diesel fuel product can be higher for Configuration F relative to Configuration E, and higher still for Configuration G. Of course, the relative diesel yield of the configurations can be modified, such as by recycling a portion of the bottoms for further conversion.

Any of Configurations B, C, or D can be matched with any of Configurations E, F, or G in a two stage reaction system, such as the two stage system shown in FIG. 2. The bottoms portion from a second stage of any of the above combinations can have an appropriate pour point for use as a lubricant oil base stock, such as a Group II, Group II+, or Group III base stock. However, the aromatics content may be too high depending on the nature of the feed and the selected reaction conditions. Therefore a hydrofinishing stage can optionally be used with any of the combinations.

It is noted that some combinations of Configuration B, C, or D with a configuration from Configuration F, F, or G will result in the final bed of the first stage being of a similar type of catalyst to the initial bed of the second stage. For example, a combination of Configuration C with Configuration G would result in having dewaxing catalyst in both the last bed of the first stage and in the initial bed of the second stage. This situation still is beneficial, as the consecutive stages can allow less severe reaction conditions to be selected in each stage while still achieving desired levels of improvement in cold flow properties. This is in addition to the benefit of having dewaxing catalyst in the first stage to improve the cold flow properties of a diesel product separated from the effluent of the first stage.

Although Configurations B, C, and D have some advantages relative to Configuration A, in some embodiments Configuration A can also be used for the first stage. In particular, Configuration A can be used with Configurations E or G, where a dewaxing catalyst is followed by a hydrocracking catalyst.

Note that Configurations E, F, G, or can optionally be expanded to include still more catalyst beds. For example, one or more additional dewaxing and/or hydrocracking catalyst beds can be included after the final dewaxing or catalyst bed shown in a Configuration. Additional beds can be included in any convenient order. For example, one possible extension for Configuration E would be to have a series of alternating beds of dewaxing catalyst and hydrocracking catalyst. For a series of four beds, this could result in a series of dewaxing-hydrocracking-dewaxing-hydrocracking. A similar extension of Configuration F could be used to make a series of hydrocracking-dewaxing-hydrocracking dewaxing. A hydrofinishing catalyst bed could then be added after the final additional hydrocracking or dewaxing catalyst bed.

One example of a combination of configurations can be a combination of Configuration B with any of Configurations E, F, G, or H, or in particular a combination with Configuration F or H. These types of configurations can potentially be advantageous for increasing the diesel yield from a feedstock while reducing the amount of naphtha and maintaining a reasonable yield of lubricant base oil. Configuration B does not include a hydrocracking stage, so any diesel boiling range molecules present in a feed after only hydrotreatment and dewaxing are removed prior to hydrocracking. The second stage can then be operated to generate a desired level of conversion to diesel boiling range molecules without overcracking of any diesel molecules present in the initial feed.

Another example of a combination of configurations can be a combination of Configuration D with any of Configurations E, F, G, or H, or in particular a combination with Configuration E or U. These types of configurations can potentially be advantageous for maximizing the diesel yield from a feedstock. In Configuration D, the initial dewaxing catalyst bed can be used to make longer chain paraffins in a feedstock more accessible to the following hydrocracking catalyst. This can allow for the higher amounts of conversion under milder conditions, as the dewaxing catalyst is used to facilitate the hydrocracking instead of using increased temperature or hydrogen partial pressure. The conversion process can be continued in the second stage. Note that this type of configuration can include a recycle loop on the second stage to further increase diesel production. This could include an extinction recycle if no lube product is desired.

Yet another example of a combination of configurations can be a combination of Configuration C with any of Configurations E, F, G, or H, or in particular a combination with Configuration F or H. These types of configurations can potentially be advantageous for emphasizing lubricant base oil production in a reduced footprint reactor. Having a dewaxing catalyst in Configuration C after the initial hydrocracking stage can allow the initial hydrocracking to occur with a reduced impact on the paraffin molecules in a feed. This can preserve a greater amount of lubricant base oil yield while still having the benefit of producing a dewaxed diesel fuel product from the first reaction stage.

If a lubricant base stock product is desired, the lubricant base stock product can be further fractionated to form a plurality of products. For example, lubricant base stock products can be made corresponding to a 2 cSt cut, a 4 cSt cut, a 6 cSt cut, and/or a cut having a viscosity higher than 6 cSt. For example, a lubricant base oil product fraction having a viscosity of at least 2 cSt can be a fraction suitable for use in low pour point application such as transformer oils, low temperature hydraulic oils, or automatic transmission fluid. A lubricant base oil product fraction having a viscosity of at least 4 cSt can be a fraction having a controlled volatility and low pour point, such that the fraction is suitable for engine oils made according to SAE J300 in 0W- or 5W- or 10W-grades. This fractionation can be performed at the time the diesel (or other fuel) product from the second stage is separated from the lubricant base stock product, or the fractionation can occur at a later time. Any hydrofinishing and/or aromatic saturation can occur either before or after fractionation. After fractionation, a lubricant base oil product fraction can be combined with appropriate additives for use as an engine oil or in another lubrication service.

Illustrative process flow schemes useful in this disclosure are disclosed in U.S. Pat. No. 8,992,764 and U.S. Patent Application Publication No. 2013/0264246, the disclosures of which are incorporated herein by reference in their entirety.

Hydrotreatment is typically used to reduce the sulfur, nitrogen, and aromatic content of a feed. Hydrotreating conditions can include temperatures of 200° C. to 450° C., or 315° C. to 425° C.; pressures of 250 psig (1.8 MPa) to 5000 psig (34.6 MPa) or 300 psig (2.1 MPa) to 3000 psig (20.8 MPa); Liquid Hourly Space Velocities (LHSV) of 0.2-10 $h^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreating catalysts are typically those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports. Suitable metal oxide supports include low acidic oxides such as silica, alumina or titanic, preferably alumina. Preferred aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support.

Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina. Examples of suitable nickel/molybdenum catalysts include KF-840, KF-848, or a stacked bed of KF-848 or KF-840 and Nebula-20.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides. The amount of Group VIB and Group VIII non-noble metals can easily be determined VIB TEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII Don-noble metal is applied. In the case where molybdenum and tungsten are present as Group VIB metals, the molybenum:tungsten ratio preferably lies in the range of 9:1-1:9. Preferably the Group VIII non-noble metal comprises nickel and/or cobalt. It is further preferred that the Group VIB metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. Bulk metal hydrotreating catalysts have a pore volume of 0.05-5 ml/g, or of 0.1-4 ml/g, or of 0.1-3 ml/g, or of 0.1-2 tag determined by nitrogen adsorption. Preferably, pores smaller than 1 nm are not present. The bulk metal hydrotreating catalysts can have a median diameter of at least 50 nm, or at least 100 nm. The bulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

Optionally, one or more beds of hydrotreatment catalyst can be located downstream from a hydrocracking catalyst bed and/or a dewaxing catalyst bed in the first stage. For these optional beds of hydrotreatment catalyst, the hydrotreatment conditions can be selected to be similar to the conditions above, or the conditions can be selected independently.

Hydrocracking catalysts typically contain sulfided base metals or Group VIII noble metals like Pt and/or Pd on acidic supports, such as amorphous silica alumina, cracking zeolites such as but not limited to zeolite X, zeolite Y, ZSM-5, mordenite, BEA, ZSM-20, ZSM-4, ZSM-50, or ZSM-12, or acidified alumina. Often these acidic supports are mixed or bound with other metal oxides such as alumina, titania or silica.

A hydrocracking process in the first stage (or otherwise under sour conditions) can be carried out at temperatures of 200° C. to 450° C., hydrogen partial pressures of from 250 psig to 5000 psig (1.8 MPa to 34.6 MPa), liquid hourly space velocities of from 0.2 $h^{-1}$ to 10 $h^{-1}$, and hydrogen treat gas rates of from 35.6 $m^3/m^3$ to 1781 $m^3/m$ (200 SCF/B to 10,000 SCF/B). Typically, in most cases, the conditions will have temperatures in the range of 300° C. to 450° C., hydrogen partial pressures of from 500 psig to 2000 psig (3.5 MPa-13.9 MPa), liquid hourly space velocities of from 0.3 $h^{-1}$ to 2 $h^{-1}$ and hydrogen treat gas rates of from 213 $m^3/m^3$ to 1068 $m^3/m^3$ (1200 SCF/B to 6000 SCF/B).

A hydrocracking process in a second stage (or otherwise under non-sour conditions) can be performed under conditions similar to those used for a first stage hydrocracking process, or the conditions can be different. In an embodiment, the conditions in a second stage can have less severe conditions than a hydrocracking process in a first (sour) stage. The temperature in the hydrocracking process can be 20° C. less than the temperature for a hydrocracking process in the first stage, or 30° C. less, or 40° C. less. The pressure for a hydrocracking process in a second stage can be 100 psig (690 kPa) less than a hydrocracking process in the first stage, or 200 psig (1380 kPa) less, or 300 psig (2070 kPa) less.

In some embodiments, a hydrofinishing and/or aromatic saturation process can also be provided. The hydrofinishing and/or aromatic saturation can occur after the last hydrocracking or dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on one or more lubricant base stock portions. Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., total pressures from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$.

In various embodiments, catalytic dewaxing can be included as part of the hydroprocessing in a first stage (or otherwise in a sour environment.) Because a separation does not occur in the first stage, any sulfur in the feed at the beginning of the stage will still be in the effluent that is passed to the catalytic dewaxing step in some form. For example, consider a first stage that includes hydrotreatment catalyst, hydrocracking catalyst, and dewaxing catalyst. A portion of the organic sulfur in the feed to the stage will be converted to $H_2S$ during hydrotreating and/or hydrocracking. Similarly, organic nitrogen in the feed will be converted to ammonia. However, without a separation step, the $H_2S$ and $NH_3$ formed during hydrotreating will travel with the effluent to the catalytic dewaxing stage. The lack of a separation step also means that any light gases ($C_1$-$C_4$) formed during hydrocracking will still be present in the effluent. The total combined sulfur from the hydrotreating process in both organic liquid form and gas phase (hydrogen sulfide) may be greater than 1,000 ppm by weight, or at least 2,000 ppm by weight, or at least 5,000 ppm by weight, or at least 10,000 ppm by weight, or at least 20,000 ppm by weight, or at least 40,000 ppm by weight. For the present disclosure, these sulfur levels are defined in terms of the total combined sulfur in liquid and gas forms fed to the dewaxing stage in parts per million (ppm) by weight on the hydrotreated feed stock basis.

Elimination of a separation step in the first reaction stage is enabled in part by the ability of a dewaxing catalyst to maintain catalytic activity in the presence of elevated levels of nitrogen and sulfur. Conventional catalysts often require pre-treatment of a feedstream to reduce the sulfur content to less than a few hundred ppm. By contrast, hydrocarbon feedstreams containing up to 4.0 wt % of sulfur or more can be effectively processed using the inventive catalysts. In an embodiment, the total combined sulfur content in liquid and gas forms of the hydrogen containing gas and hydrotreated feed stock can be at least 0.1 wt %, or at least 0.2 wt %, or at least 0.4 wt %, or at least 0.5 wt %, or at least 1 wt %, or at least 2 wt %, or at least 4 wt %. Sulfur content may be measured by standard ASTM methods D2622.

Hydrogen treat gas circulation loops and make-up gas can be configured and controlled in any number of ways. In the direct cascade, treat gas enters the hydrotreating reactor and can be once through or circulated by compressor from high pressure flash drums at the back end of the hydrocracking and/or dewaxing section of the unit. In circulation mode, make-up gas can be put into the unit anywhere in the high pressure circuit preferably into the hydrocracking/dewaxing reactor zone. In circulation mode, the treat gas may be scrubbed with amine, or any other suitable solution, to remove $H_2S$ and $NH_3$. In another form, the treat gas can be recycled without cleaning or scrubbing. Alternately, the liquid effluent may be combined with any hydrogen containing gas, including but not limited to $H_2S$ containing gas.

Preferably, the dewaxing catalysts according to the disclosure are zeolites that perform dewaxing primarily by isomerizing a hydrocarbon feed stock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %

The dewaxing catalysts useful in processes according to the disclosure can also include a binder. In some embodiments, the dewaxing catalysts used in process according to the disclosure are formulated using a low surface area binder, a low surface area binder represents a binder with a surface area of 100 $m^2/g$ or less, or 80 $m^2/g$ or less, or 70 $m^2/g$ or less.

Alternatively, the binder and the zeolite particle size are selected to provide a catalyst with a desired ratio of micropore surface area to total surface area. In dewaxing catalysts used according to the disclosure, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

In yet another embodiment, the dewaxing catalyst is self-bound and does not contain a binder.

Process conditions in a catalytic dewaxing zone in a sour environment can include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B).

For dewaxing in the second stage (or other non-sour environment), the dewaxing catalyst conditions can be similar to those for a sour environment. In an embodiment, the conditions in a second stage can have less severe conditions than a dewaxing process in a first (sour) stage. The temperature in the dewaxing process can be 20° C. less than the temperature for a dewaxing process in the first stage, or 30° C. less, or 40° C. less. One method to achieve lower temperatures in the dewaxing stage is to use liquid quench. By recycling dewaxed and optionally hydrofinished products, either as a total reactor effluent or separated into a specific boiling range which is cooled to a lower temperature, the total feed temperature into the dewaxing can be lowered. Another method to reduce the dewaxing feed temperature is to use external cooling on the total reactor effluent from the optional hydrocracking step by withdrawing the feed to the dewaxing stage and exchanging heat with a colder stream or the atmosphere. Another method to reduce the dewaxing reactor temperature and be by adding colder gas, such as hydrogen, and mixing with the dewaxing catalyst feed. The pressure for a dewaxing process in a second stage can be 100 psig (690 kPa) less than a dewaxing process in the first stage, or 200 psig (1380 kPa) less, or 300 psig (2070 kPa) less.

In one form the of the present disclosure, the catalytic dewaxing catalyst includes from 0.1 wt % to 3.33 wt % framework alumina, 0.1 wt % to 5 wt % Pt, 200:1 to 30:1 $SiO_2$:$Al_2O_3$ ratio and at least one low surface area, refractory metal oxide binder with a surface area of 100 $m^2/g$ or less.

Lubricating Oil Additives

The formulated lubricating oil useful in the present disclosure may contain one or more of the other commonly used lubricating oil performance additives including but not limited to antiwear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see "Lubricant Additives, Chemistry and Applications", Ed. L. R. Rudnick, Marcel Dekker, Inc. 270 Madison Ave. New York, N.J. 10016, 2003, and Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil that may range from 5 weight percent to 50 weight percent.

The additives useful in this disclosure do not have to be soluble in the lubricating oils. Insoluble additives such as zinc stearate in oil can be dispersed in the lubricating oils of this disclosure.

When lubricating oil compositions contain one or more additives, the additive(s) are blended into the composition in an amount sufficient for it to perform its intended function. Additives are typically present in lubricating oil compositions as a minor component, typically in an amount of less than 50 weight percent, preferably less than about 30 weight percent, and more preferably less than about 15 weight percent, based on the total weight of the composition.

Additives are most often added to lubricating oil compositions in an amount of at least 0.1 weight percent, preferably at least 1 weight percent, more preferably at least 5 weight percent. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the Table 1 below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The lube base stocks of the present disclosure are well suited as lube base stocks without blending limitations, and further, the lube base stock products are also compatible with lubricant additives for lubricant formulations. The lube base stocks of the present disclosure can optionally be blended with other lube base stocks to form lubricants. Useful cobase lube stocks include Group I, III, IV and V base stocks and gas-to-liquid (GTL) oils. One or more of the cobase stocks may be blended into a lubricant composition including the lube base stock at from 0.1 to 50 wt. %, or 0.5 to 40 wt. %, 1 to 35 wt. %, or 2 to 30 wt. %, or 5 to 25 wt. %, or 10 to 20 wt. %, based on the total lubricant composition.

Lubricant compositions including the base stock of the instant disclosure have improved oxidative stability than analogous lubricant compositions including prior art Group II base stocks.

The lube base stocks and lubricant compositions can be employed in the present disclosure in a variety of lubricant-related end uses, such as a lubricant oil or grease for a device or apparatus requiring lubrication of moving and/or interacting mechanical parts, components, or surfaces. Useful apparatuses include engines and machines. The lube base stocks of the present disclosure are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids. Furthermore, the lube base stocks of this disclosure are derived from renewable sources; it is considered a sustainable product and can meet "sustainability" standards set by different industry groups or government regulations.

The following non-limiting examples are provided to illustrate the disclosure.

EXAMPLES

As described herein, FIG. 1 is a schematic of a hydrocracking process for lubes which was used to produce the compositionally advantaged base stocks with superior low temperature and oxidation performance of this disclosure. The process used in the Examples is disclosed herein. A feed (i.e., a vacuum gas oil feed stock (i.e., a medium vacuum gas oil feeds (MVGO)) having a solvent dewaxed oil feed viscosity index of from about 20 to about 45 was processed through the first stage which is primarily a hydrotreating unit which boosts viscosity index (VI) and removes sulfur and nitrogen. This was followed by a stripping section where light ends and diesel were removed. The heavier lube fraction then entered the second stage where hydrocracking, dewaxing, and hydrofinishing were done. This combination of feed and process approaches has been found to produce a base stock with unique compositional characteristics. These unique compositional characteristics were observed in both the lower and higher viscosity base stocks produced.

The lubricating oil base stocks were produced by co-processing a feed (i.e., a vacuum gas oil feed stock (e.g., a medium vacuum gas oil feeds (MVGO)) having a solvent dewaxed oil feed viscosity index of from about 20 to about 45) to hit conventional VI targets for the low viscosity cut which yielded the low viscosity product with unique compositional characteristics as compared with conventionally processed low viscosity base stocks. The lubricating oil base stock composition was determined using a combination of advanced analytical techniques including gas chromatography mass spectrometry (GCMS), supercritical fluid chromatography (SFC), carbon-13 nuclear magnetic resonance (13C NMR), proton nuclear magnetic resonance (proton-NMR), and differential scanning calorimetry (DSC). Examples of Group II low viscosity lubricating oil base stocks of this disclosure and having a kinematic viscosity at 100° C. in the range of 4-6 cSt are described in FIG. 9. For reference, the low viscosity lubricating oil base stocks of this disclosure are compared with typical Group II low viscosity base stocks having the same viscosity range.

The co-processed high viscosity product from the above described process also showed the unique compositional characteristics described herein. Examples of such Group II high viscosity lubricating oil base stocks having kinematic viscosity at 100° C. in the range of 10-12 cSt are described in FIG. 10. For reference, the high viscosity lubricating oil base stocks of this disclosure are compared with typical Group II high viscosity base stocks having the same viscosity range.

As used in FIGS. 9 and 10, "Sats X-0" refers to the amount of one (1) ring cycloparaffins and naphthenoaromatics; "Sats X-2" refers to the amount of two (2) ring cycloparaffins and naphthenoaromatics; "Sats X-4" refers to the amount of three (3) ring cycloparaffins and naphthenoaromatics; "Sats X-6" refers to the amount of four (4) ring cycloparaffins and naphthenoaromatics; "Sats X-8" refers to the amount of five (5) ring cycloparaffins and naphthenoaromatics; "Sats X-10" refers to the amount of six (6) ring cycloparaffins and naphthenoaromatics; and "Sats X2"

refers to the amount of isoparaffins. "MM paraffins" refers to monomethyl parafins. "DM paraffins" refers to dimethyl paraffins. "Total Cycloparaffins" refers to the total amount cycloparaffins and naphthenoaromatics. As used in FIGS. 9 and 10, cycloparaffins includes naphthenoaromatics.

As used in FIGS. 9 and 10, viscosity index (VI) was determined according to ASTM method D 2270-93 [1998]. VI is related to kinematic viscosities measured at 40° C. and 100° C. using ASTM Method D 445-01.

As used in FIG. 10, the pour point was measured by ASTM B3983 or D5950-1.

The Group II base stocks with unique compositions (examples in FIGS. 9 and 10) produced by the hydrocracking process exhibit a range of base stock viscosities from 3.5 cst to 13 cst. These differences in composition include a difference in distribution of the cycloparaffin ring and naphthenoaromatic ring species and lead to larger relative amounts of one ring compared to multi-ring cycloparaffins and naphthenoaromatics. FIGS. 9 and 10, referring to line 14 in each, shows the ratio of the one ring cycloparaffin species to mult-ring cycloparaffins species, relative to commercially available hydroprocessed base stocks, for the low viscosity product exceeding 1.1 in the base stocks of this disclosure, and in the high viscosity product exceeding 1.2 in the base stocks of this disclosure. This difference in composition is believed to be favored.

Additionally, in these base stocks of this disclosure, the absolute value of multi-ring cycloparaffins and naphthenoaromatics as show in FIGS. 9 and 10, rows 15, 16, and 17 of each, for 2+, 3+, 4+ ring cycloparaffins and naphthenoaromatics is lower in the base stocks of this disclosure as compared to commercially known stocks across the range of viscosities. Specifically, the example base stocks of this disclosure showed less than 35.7% species with −2 X-class as shown in FIG. 8, predominantly 2+ ring cycloparaffins and naphthenoaromatics of −2 X-class, less than 11.0% species with −4 X-class as shown in FIG. 8, predominantly 3+ ring cycloparaffins and naphthenoaromatics of −4 X-class, and less than 3.7% species with −6 X-class as shown in FIG. 8, predominantly 4+ ring cycloparaffins and naphthenoaromatics of −6 X-class, in the low viscosity product, and less than 39.0% species with −2 X-class as shown in FIG. 8, predominantly 2+ ring cycloparaffins and naphthenoaromatics of −2 X-class, less than 10.8% species with −4 X-class as shown in FIG. 8, predominantly 3+ ring cycloparaffins and naphthenoaromatics of −4 X-class, and less than 3.2% species with −6 X-class as shown in FIG. 8, predominantly 4+ ring cycloparaffins and naphthenoaromatics of −6 X-class, for the high viscosity product. The lower amounts of the multi-ring cycloparaffins and naphthenoaromatics can also be seen by looking at individual numbers of 3 ring species (FIGS. 9 and 10, line 7 of each); less than 7.8% for the low viscosity product and less than 7.9% for the high viscosity product. Additionally, the base stocks of this disclosure also showed higher amounts of the monocycloparaffin species (FIGS. 9 and 10, line 5 of each) across the full viscosity range; greater than 40.7% for the low viscosity base stocks and greater than 38.8% for the high viscosity base stocks. In addition, the base stocks of this disclosure can include naphthenoaromatic species of correspondingly the same X-class as shown in FIG. 8, preferably a total amount less than 5%, and more preferably a total amount less than 2%.

Further, using a specific feed (i.e., a vacuum gas oil feed stock (i.e., a medium vacuum gas oil feed (MVGO)) having a solvent dewaxed oil feed viscosity index of from about 20 to about 45) gives additional advantages on the heavier base stocks co-produced with the lighter base stocks. As seen in FIG. 10, line 4 thereof, the high viscosity base stocks of this disclosure show significantly lower total cycloparaffin content (less than 75%) compared to commercial base stocks, averaging closer to 80%. This is also evidenced by higher VI, exceeding 106.2 where the base stocks of this disclosure have VI in the 106-112 range.

Additionally, the high viscosity base stocks showed lower degree of branching on the iso-paraffin portion of the species as evidenced by greater than 13.3 epsilon carbon atoms per 100 carbon atoms as measured by 13C-NMR, and a greater number of long alkyl branches on iso-paraffin portion of the species as evidence by greater than 2.8 alpha carbon atoms per 100 carbon atoms as measured by 13C-NMR (FIG. 10, lines 18 and 20). Some unique combinations of properties were also seen specifically in the low viscosity base stock co-produced with the high viscosity product. For example, the low viscosity base stocks of this disclosure were seen to have epsilon carbon content less than 11.3% while retaining viscosity index greater than 110 (FIG. 9, lines 18 and 3).

A detailed summary of compositional characteristics of the exemplary base stocks of this disclosure included in FIGS. 9 and 10 is set forth below.

For base stocks with a kinematic viscosity in the range 4-6 cSt at 100° C., the composition is such that:

monocycloparaffinic species, as measured by GCMS, constitute greater than 44% or 46% or 48% of all species;

the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) relative to the same ratio in a similar commercially available hydroprocessed base stock (cycloparaffin performance ratio) is greater than 1.1 or 1.2 or 1.3 or 1.4 or 1.5 or 1.6 as measured by GCMS;

the sum of all species with hydrogen deficiency X-class of −2, −4, −6, −8 and −10, as measured by GCMS, i.e., 2+ ring cycloparaffinic and naphthenoaromatic species constitute less than <34% or <33% or <31% or <30% of all species;

the sum of all species with hydrogen deficiency X-class of −4, −6, −8 and −10, as measured by GCMS, i.e., 3+ ring cycloparaffinic and naphthenoaromatic species constitute less than 10.5% or <9.5% or <9% or <8.5% of all species;

the sum of all species with hydrogen deficiency X-class of −6, −8 and −10, as measured by GCMS, i.e. 4+ ring cycloparaffinic and naphthenoaromatic species constitute less than 2.9% or <2.7% or <2.6% of all species;

longer branches on iso-paraffin/alkyl portion of the species evidenced by greater than 1.1 tertiary or pendant propyl groups per 100 carbon atoms as measured by 13C-NMR; and monomethyl paraffin species, as measured by GCMS, constitute <1.3%, or <1.1%, or <0.9%, or <0.8%, or <0.7% of all species.

For base stocks with a kinematic viscosity in the range 10-14 cSt at 100° C., the composition is such that:

monocycloparaffinic species, as measured by GCMS, constitute greater than 39% or >39.5% or >40% or >41% of all species;

the sum of cycloparaffinic and naphthenoaromatic species, i.e., all species with hydrogen deficiency X-class of 0, −2, −4, −6, −8, and −10 constitute <73% or <72% or <71% of all species;

the ratio of monocycloparaffinic (hydrogen deficiency X-class of 0) to multi-ring cycloparaffinic and naphthenoaromatic species (sum of species with hydrogen deficiency X-class of −2, −4, −6, −8 and −10) relative to the same ratio in a similar commercially available hydroprocessed base stock (cycloparaffin performance ratio) is greater than 1.05, or >1.1, or >1.2, or >1.3, or >1.4 as measured by GCMS;

the sum of all species with hydrogen deficiency X-class of −2, −4, −6, −8 and −10, as measured by GCMS, i.e. 2+ ring cycloparaffinic and naphthenoaromatic species constitute less than <36% or <35% or <34% or <32% or <30% of all species;

the sum of all species with hydrogen deficiency X-class of −4, −6, −8 and −10, as measured by GCMS, i.e., 3+ ring cycloparaffinic and naphthenoaromatic species constitute less than 10.5%, or <10% or <9% or <8% of all species;

the sum of all species with hydrogen deficiency X-class of −6, −8 and −10, as measured by GCMS, i.e., 4+ ring cycloparaffinic and naphthenoaromatic species constitute less than 2.8%, or <2.8% of all species;

higher degree of branching on iso-paraffin/alkyl portion of the species evidenced by greater than 13, or >14 or >14.5 epsilon carbon atoms per 100 carbon atoms as measured by 13C-NMR;

greater number of long alkyl branches on iso-paraffin/alkyl portion of the species evidenced by greater than 2.7, or >2.8, or >2.85, or >2.9, or >2.95 alpha carbon atoms per 100 carbon atoms as measured by 13C-NMR; and residual wax distribution characterized by rapid rate of heat flow increase (0.0005-0.0015 W/g·T) with the melting of microcrystalline wax by the DSC method.

It is noteworthy that the exemplary base stocks of this disclosure have lower contents of total cycloparaffins as compared to the typical Group II base stocks. This is believed to provide the VI advantage of the base stocks of this disclosure seen over the reference samples. Surprisingly, the base stocks of this disclosure also have higher content of the X-class 0 ring species (corresponding to monocycloparaffinic species), despite the lower overall cycloparaffin content and naphthenoaromatic species content. While not being bound by theory, one hypothesis for the lower amounts of multi-ring cycloparaffins and naphthenoaromatics is that ring opening reactions that lead to low multi-ring cycloparaffins and naphthenoaromatics may have high selectivity under the process conditions used to make the base stocks of this disclosure. The process scheme used to make the base stocks of this disclosure enables greater use of noble metal catalysts having acidic sites under low sulphur (sweet) processing conditions that may favor ring opening reactions that potentially improve VI.

Figure 11:
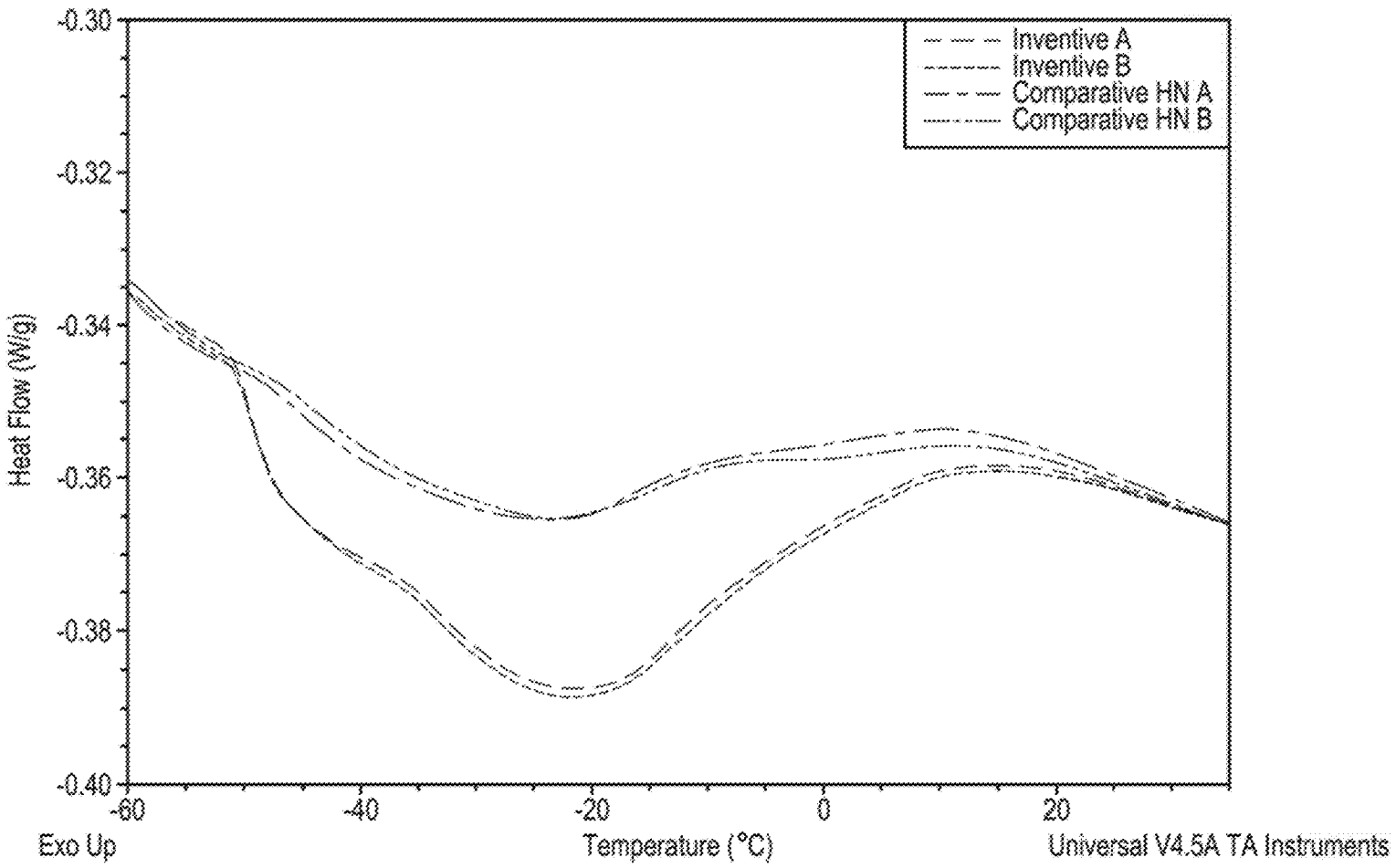
FIG. 11 shows the differential scanning calorimetry (DSC) heating curves for high viscosity base stocks of this disclosure and typical commercial base stock samples.

Additionally, the base stocks of this disclosure (i.e., the inventive base stock having a VI of 107.7 in FIG. 10 (referred to as "Inventive A" in FIG. 11), and also the inventive base stock having a VI of 106.3 in FIG. 10 (referred to as "Inventive B" in FIG. 11) were also characterized using differential scanning calorimetry (DSC) to determine the total amount of residual wax and the distribution of residual wax as a function of temperature. A method to determine the low temperature performance of a base stock using a DSC residual wax distribution, by correlating the heating curve of the base stock with the MRV apparent viscosity measured by ASTM D4684 of a finished engine oil formulated from that base stock is described in U.S. Patent Application Publication No. 2010/0070202. The DSC cooling and heating curves were obtained for the base stocks of this disclosure. Notably, the heating curve was generated by starting from a low temperature of nearly −80° C. at which the sample is completely solidified, and then heating the sample at around 10° C./min. As the temperature increases, typically, the heat flow rapidly decreases till the temperature is about −25° C. The heating trace goes through a minima at around −30 to −20° C. Between −20° C. and around +10° C., the rate of heat flow increases as the microcrystalline wax melts. The typical rate of increase is 0.00025-0.00040 W/g·T whereas, surprisingly, the base stock of this disclosure had a more rapid change in heat flow at a rate of 0.0005-0.0015 W/g·T indicative of a unique composition and content of residual waxes/paraffinic species. FIG. 11 shows the DSC heating curves for base stocks of this disclosure and typical commercial samples (i.e., the ExxonMobil base stock having a VI of 96.9 in FIG. 10 (referred to as "Typical ExxonMobil HN Example A" in FIG. 11, the ExxonMobil base stock having a VI of 96.8 in FIG. 10 (referred to as "Typical ExxonMobil HN Example B" in FIG. 11, and also the Comparative HN A, Comparative HN B, Comparative HN C, and Comparative HN D commercial base stocks in FIG. 10).

Figure 12:
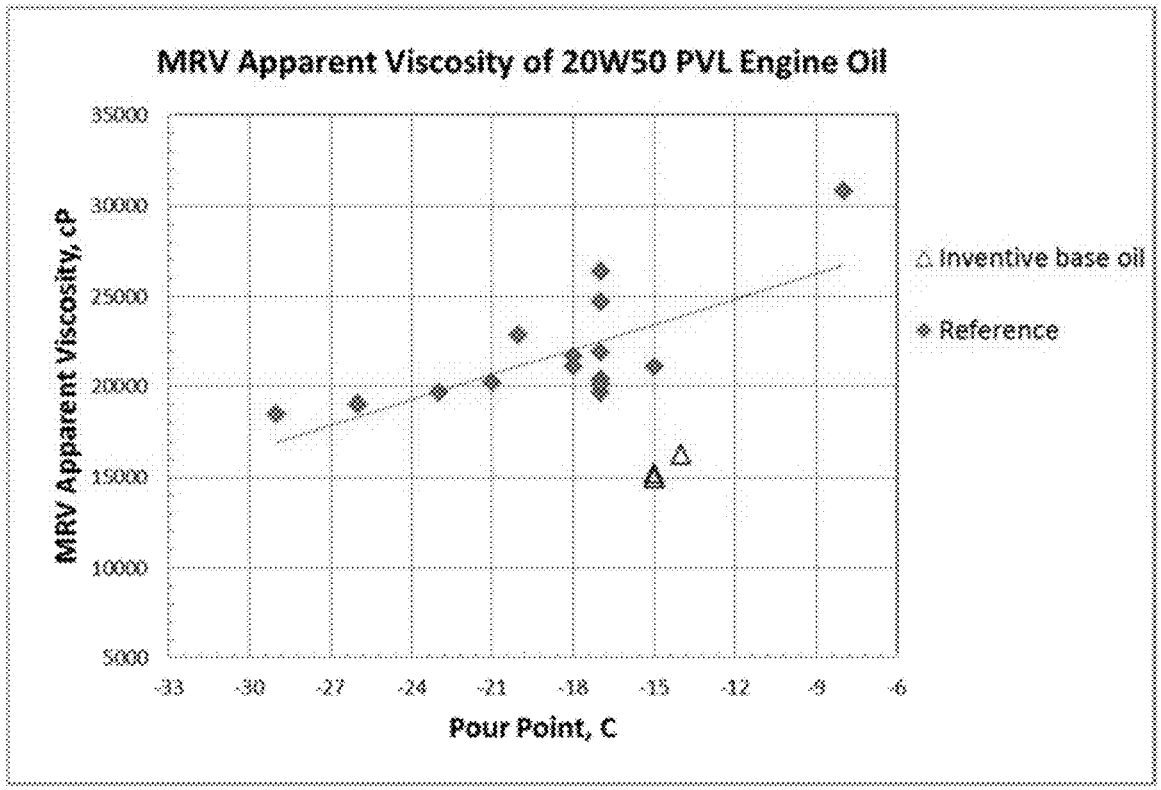
FIG. 12 shows mini-rotary viscometer (MRV) apparent viscosity measured by ASTM D4684 versus pour point for 20 W-50 engine oil formulated using a base stock of this disclosure and a reference base stock.

The base stocks of this disclosure show superior low temperature performance as measured by the MRV apparent viscosity by ASTM D4684 in a 20W-50 automotive engine oil formulation. Finished lube MRV performance measured by ASTM D4684 is correlated by base stock residual wax normally measured by pour point. It has been found, surprisingly, that with base stocks at similar pour points, 25% reduction in finished lube MRV performance measured by ASTM D4684 can be achieved using the base stocks of this disclosure. An example is shown in FIG. 12. FIG. 12 shows MRV apparent viscosity measured by ASTM D4684 versus pour point for 20W-50 engine oil formulated using a base stock of this disclosure (i.e., the inventive base stock having a VI of 107.7 in FIG. 10) and a reference base stock (i.e., the ExxonMobil base stock having a VI of 96.9 in FIG. 10).

In accordance with this disclosure, a method to improve MRV measured by ASTM D4684 by increasing amounts of iso-paraffin and monocycloparaffin species is provided. As described herein, the base stocks of this disclosure have a lower multi-ring cycloparaffin and naphthenoaromatic content and a higher monocycloparaffin content that may be contributing to the improvement in low temperature performance. This is surprising because relatively small changes in cycloparaffin and naphthenoaromatic content would not be expected to influence low temperature performance. There is believed to be an interesting distribution of saturated species including cycloparaffins and/or branched long chain paraffins that may be contributing. Thus, in an embodiment, this disclosure provides a method to improve the MRV performance measured by ASTM D4684 by converting multi-ring cyclo-paraffins down to mono-cycloparaffins by more severe processing and then blending this base oil with low multi-ring cycloparaffinic species into formulations.

Additionally, $^{13}$C NMR spectroscopy shows that the high viscosity base stocks of this disclosure are comprised of species with higher content of epsilon carbons (>13%) and alpha carbons (>2.8%), while having the same average carbon number as typical base stocks (in the range 30-40). Examples of observations of epsilon and alpha carbon content for the base stocks of this disclosure are shown in FIG. 10 in rows 18 and 20. Higher content of alpha carbon species suggests higher degree of branching in the saturated species, but is expected to lead to lower epsilon carbon content (indicative of long unbranched paraffin chains). Since the base stocks of this disclosure also show higher content of epsilon carbon species, along with higher content of alpha carbons, an interesting distribution of species with longer branches and more number of branches is believed to be present.

In accordance with this disclosure, a method is provided to improve rotary pressure vessel oxidation test (RPVOT) measured by ASTM D2272 by reducing the multi-ring cycloparaffinic and naphthenoaromatic species. The base stocks of this disclosure, in particular higher viscosity base stocks, showed directionally lower amounts of cycloparaffins than the similar viscosity other API Group II base stocks. Also, individual cycloparaffin type molecules distribution in such base stocks was different than those for other similar viscosity competitive Group II base stocks. This compositional difference in the base stocks of this disclosure resulted in the directionally better oxidative stability as measured by RPVOT by ASTM D2272 on turbine oil formulations. While not being limited by the theory, it is believed that the certain type of cycloparaffinic molecules are preferred over other types of cycloparaffinic molecules for providing better oxidation stability either by inhibition in the oxidation initiation reactions or perhaps keep oxidation product in the solution. It is also believed that iso-paraffinic molecules may be even more preferred than cycloparaffinic type molecules. This results in higher RPVOT average time. Thus, this disclosure provides a method to control the oxidative stability by specifically reducing the multi-ring cycloparaffinic and naphthenoaromatic species per the compositional space as follows:

overall cycloparaffin molecules content 2-7% lower than the competitive base stocks;

single ring class cycloparaffinic molecules were 2-4% higher;

two rings class cycloparaffinic molecules were 2-5% lower;

three rings class cycloparaffinic molecules were 1-6% lower; and sum of all 4 hydrogen deficient class and naphthenoaromatic molecules is about 10% which is about 2-6% lower.

Figure 13:
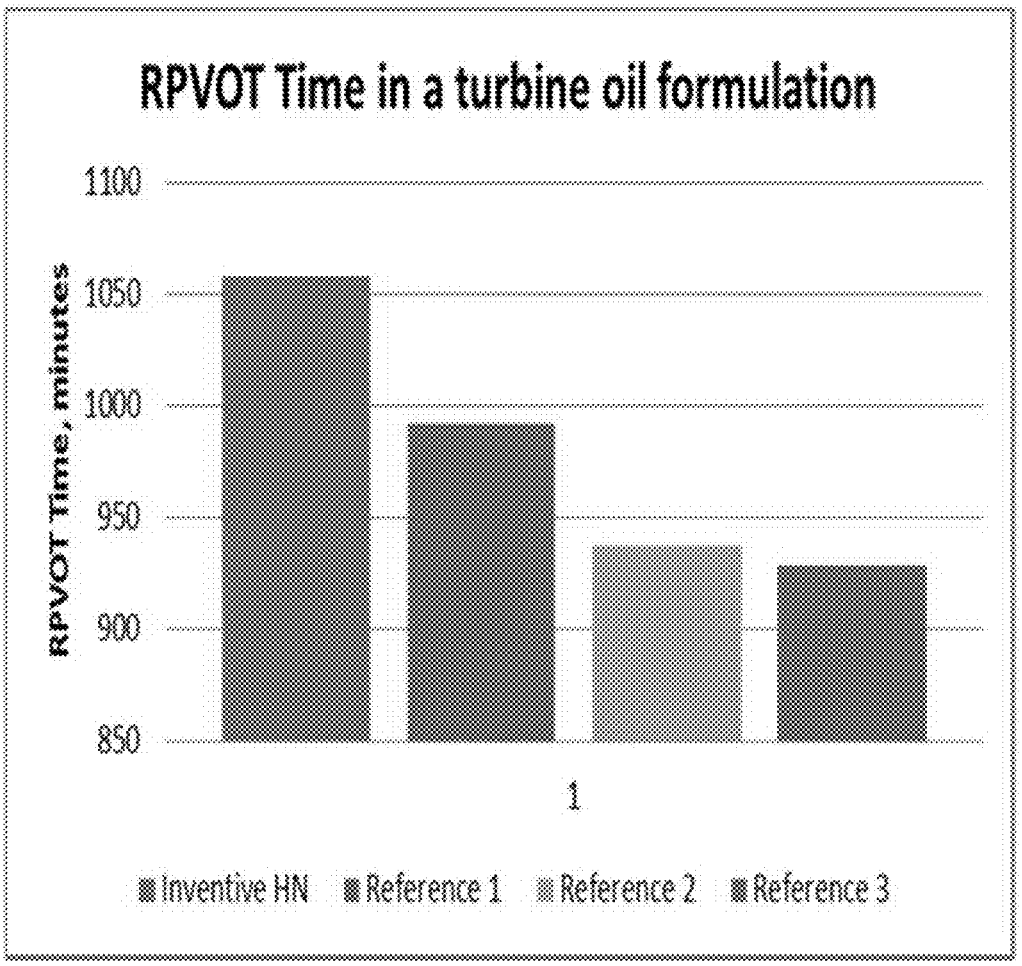
FIG. 13 graphically shows comparative RPVOT time measured by ASTM D2272 on a turbine oil formulation with a high viscosity Group II base stock of this disclosure to similar quality competitive high viscosity base stocks to show the quality difference.

A comparative RPVOT time measured by ASTM D2272 on a turbine oil formulation with a high viscosity Group II base stock of this disclosure (i.e., the inventive base stock having a VI of 107.7 in FIG. 10) to similar quality competitive high viscosity base stocks (i.e., the ExxonMobil base stock having a VI of 96.9 in FIG. 10 referred to as "Reference 1" in FIG. 13, the ExxonMobil base stock having a VI of 96.8 in FIG. 10 referred to as "Reference 2" in FIG. 13, and the ExxonMobil base stock having a VI of 94.7 in FIG. 10 referred to as "Reference 3" in FIG. 13) is graphically shown in FIG. 13 to show the quality difference.

Figure 14:
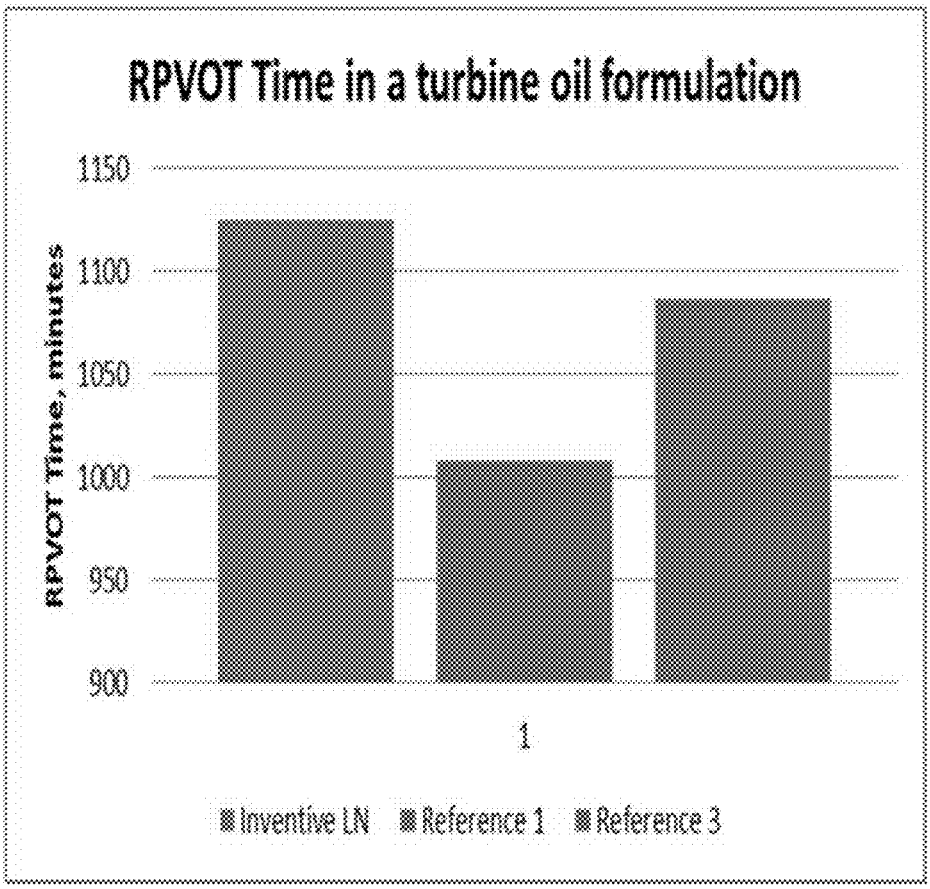
FIG. 14 graphically shows comparative RPVOT time measured by ASTM D2272 on a turbine oil formulation with a low viscosity Group II base stock of this disclosure to similar quality competitive low viscosity base stocks to show the quality difference.

Also, a comparative RPVOT time measured by ASTM D2272 on a turbine oil formulation with a low viscosity Group II base stock of this disclosure (i.e., the inventive base stock having a VI of 110.5 in FIG. 9) to similar quality competitive low viscosity base stocks (i.e., the ExxonMobil base stock having a VI of 115.0 in FIG. 9 referred to as "Reference 1" in FIG. 14, and the ExxonMobil base stock having a VI of 114.5 in FIG. 9 referred to as "Reference 3" in FIG. 14) is graphically shown in FIG. 14 to show the quality difference.

Additional lubricating oil base stocks were produced by co-processing a feed (i.e., a vacuum gas oil feed stock (i.e., a medium vacuum gas oil feed (MVGO)) having a solvent dewaxed oil feed viscosity index of from about 20 to about 45, or a mixed feed stock having a vacuum gas oil feed (e.g., a medium vacuum gas oil feed (MVGO)) to hit conventional VI targets for the low viscosity cut which yielded the low viscosity product with unique compositional characteristics as compared with conventionally processed low viscosity base stocks. The lubricating oil base stock composition was determined using a combination of advanced analytical techniques including gas chromatography mass spectrometry (GCMS), supercritical fluid chromatography (SFC), carbon-13 nuclear magnetic resonance (13C NMR), proton nuclear magnetic resonance (proton-NMR), ultra violet spectroscopy, and differential scanning calorimetry (DSC). Examples of Group II low viscosity lubricating oil base stocks of this disclosure and having a kinematic viscosity at 100° C. in the range of 4-6 cSt are described in FIG. 15.

The co-processed high viscosity product from the above described process also showed the unique compositional characteristics described herein. Examples of such Group II high viscosity lubricating oil base stocks having kinematic viscosity at 100° C. in the range of 10-14 cSt are also described in FIG. 15.

FIG. 16 shows a comparison of the amount and distribution of aromatics, as determined by ultra violet (UV) spectroscopy, in lubricating oil base stocks (i.e., a 4.5 cSt base stock of U.S. Patent application Publication No. 2013/0264246, a 4.5 cSt state of the art base stock as disclosed in U.S. Patent application Publication No. 2013/0264246, a 5 cSt base stock of this disclosure, and a 11+ cSt base stock of this disclosure).

For GCMS used herein, approximately 50 milligram of a base stock sample was added to a standard 2 milliliter auto-sampler vial and diluted with methylene chloride solvent to fill the vial. Vials were sealed with septum caps. Samples were run using an Agilent 5975C GCMS (Gas Chromatograph Mass Spectrometer) equipped with an auto-sampler. A non-polar GC column was used to simulate distillation or carbon number elution characteristics off the GC. The GC column used was a Restek Rxi −1 ms. The column dimensions were 30 meters in length×0.32 mm internal diameter with a 0.25 micron film thickness for the stationary phase coating. The GC column was connected to the split/split-less injection port (held at 360° C. and operated in split-less mode) of the GC. Helium in constant pressure mode (~7 PSI) was used for GC carrier phase. The outlet of the GC column was run into mass spectrometer via a transfer line held at a 350° C. The temperature program for the GC column is a follows: 2 minute hold at 100° C., program at 5° C. per minute, 30 minute hold at 350° C. The mass spectrometer was operated using an electron impact ionization source (held at 250° C.) and operated using standard conditions (70 eV ionization). Instrumental control and mass spectral data acquisition were obtained using the Agilent Chemstation software. Mass calibration and instrument tuning performance validated using vendor supplied standard based on instrument auto tune feature.

GCMS retention times for samples were determined relative to a normal paraffin retention based on analysis of standard sample containing known normal paraffins. Then the mass spectrum was averaged. A group type analysis of for saturates fractions based on the characteristic fragment ions was performed. The group type analysis yielded the weight % of the following saturate and aromatic molecular types: total cycloparaffins and naphthenoaromatics, 1-6 ring cycloparaffinic species and naphthenoaromatic species, n-paraffins, monomethyl paraffins (i.e., MM paraffins), and dimethyl paraffins (i.e., DM paraffins). This procedure is similar to industry standard method ASTM D2786-Standard Test Method for Hydrocarbon Types Analysis of Gas-Oil Saturates Fractions by High Ionizing Voltage Mass Spectrometry.

For SFC used herein, a commercial SFC (supercritical fluid chromatograph) system was employed for analysis of lube base stocks. The system was equipped with the following components: a high pressure pump for delivery of supercritical carbon dioxide mobile phase; temperature controlled column oven; auto-sampler with high pressure liquid injection valve for delivery of sample material into mobile phase; flame ionization detector; mobile phase splitter (low dead volume tee); back pressure regulator to keep the CO2 in supercritical state; and a computer and data system for control of components and recording of data signal. For analysis, approximately 75 milligrams of sample was diluted in 2 milliliters of toluene and loaded in standard septum cap autosamper vials. The sample was introduced based via the high pressure sampling valve. The SFC separation was performed using multiple commercial silica packed columns (5 micron with either 60 or 30 angstrom pores) connected in series (250 mm in length either 2 mm or 4 mm ID). Column temperature was held typically at 35 or 40° C. For analysis, the head pressure of columns was typically 250 bar. Liquid CO2 flow rates were typically 0.3 ml/minute for 2 mm ID columns or 2.0 ml/minute for 4 mm ID columns. The samples run were mostly all saturate compounds which will elute before the toluene solvent. The SFC FID signal was integrated into paraffin and naphthenic regions. A SFC (supercritical fluid chromatograph) was used to analyze lube base stocks for split of total paraffins and total naphthenes. A variety of standards employing typical molecular types can be used to calibrate the paraffin/naphthene split for quantification.

For $^{13}C$ NMR used herein, samples were prepared 25-30 wt % in CDC13 with 7% Chromium (III)-acetylacetonate added as a relaxation agent. $^{13}C$ NMR experiments were performed on a JEOL ECS NMR spectrometer for which the proton resonance frequency was 400 MHz. Quantitative $^{13}C$ NMR Experiments were performed at 27° C. using an inverse gated decoupling experiment with a 45° flip angle, 6.6 seconds between pulses, 64 K data points and 2400 scans. All spectra were referenced to TMS at 0 ppm. Spectra were processed with 0.2-1 Hz of line broadening and baseline correction was applied prior to manual integration. The entire spectrum was integrated to determine the mole % of the different integrated areas as follows: 170-190 ppm aromatic C; 30-29.5 ppm epsilon carbons (long chain methylene carbons); 15-14.5 ppm terminal and pendant propyl groups (% T/P Pr); 14.5-14 ppm methyl at the end of a long chain; and 12-10 ppm pendant and terminal ethyl groups (% P/T Et).

PCT and EP Clauses

1. A base stock comprising: at least 90 wt. % saturates; an amount and distribution of aromatics, as determined by ultra violet (UV) spectroscopy, comprising an absorptivity between 280 and 320 nm of less than 0.015 l/gm-cm; a viscosity index (VI) from 80 to 120, and having a cycloparaffin performance ratio greater than 1.05 and a kinematic viscosity at 100° C. between 4 and 6 cSt.

2. The base stock of clause 1 having an amount and distribution of aromatics, as determined by ultra violet (UV) spectroscopy, comprising:

absorptivity @ 226 nm of less than 0.15 l/g-cm;
absorptivity @ 275 nm of less than 0.013 l/g-cm;
absorptivity @ 302 nm of less than 0.005 l/g-cm;
absorptivity @ 310 nm of less than 0.006 l/g-cm; and
absorptivity @ 325 nm of less than 0.0017 l/g-cm.

3. The base stock of clause 1 having an amount and distribution of aromatics, as determined by ultra violet (UV) spectroscopy, comprising:

absorptivity @ 226 nm of less than 0.15 l/g-cm;
absorptivity @ 254 nm of less than 0.007 l/g-cm;
absorptivity @ 275 nm of less than 0.013 l/g-cm;
absorptivity @ 302 nm of less than 0.005 l/g-cm;
absorptivity @ 310 nm of less than 0.006 l/g-cm;
absorptivity @ 325 nm of less than 0.0017 l/g-cm;
absorptivity @ 339 nm of less than 0.0013 l/g-cm; and
absorptivity @ 400 nm of less than 0.00014 l/g-cm.

4. The base stock of clauses 1-3 having a cycloparaffin performance ratio is greater than 1.2.

5. The base stock of clauses 1-4 wherein the saturates comprise monocycloparaffinic species of 0 X-class, and wherein the monocycloparaffinic species are greater than 41 wt. %, based on the total wt. % of all saturates and aromatics.

6. The base stock of clauses 1-4 wherein the saturates comprise cycloparaffinic species and the aromatics comprise naphthenoaromatic species of −2 X-class, and wherein the 2+ ring species of the cycloparaffinic species and the naphthenoaromatic species are less than 35.7 wt. %, based on the total wt. % of all saturates and aromatics.

7. The base stock of clauses 1-4 wherein the saturates comprise cycloparaffinic species and the aromatics comprise naphthenoaromatic species of −4 X-class, and wherein the 3+ ring species of the cycloparaffinic species and the naphthenoaromatic species are less than 11 wt. %, based on the total wt. % of all saturates and aromatics.

8. The base stock of clauses 1-4 wherein the saturates comprise cycloparaffinic species and the aromatics comprise naphthenoaromatic species of −6 X-class, and wherein the 4+ ring species of the cycloparaffinic species and the naphthenoaromatic species are less than 3.7 wt. %, based on the total wt. % of all saturates and aromatics.

9. A base stock comprising: at least 90 wt. % saturates; an amount and distribution of aromatics, as determined by ultra violet (UV) spectroscopy, comprising an absorptivity between 280 and 320 nm of less than 0.020 l/gm-cm; a viscosity index (VI) from 80 to 120, and having a cycloparaffin performance ratio greater than 1.05 and a kinematic viscosity at 100° C. between 10 and 14 cSt.

10. The base stock of clause 9 having an amount and distribution of aromatics, as determined by ultra violet (UV) spectroscopy, comprising:

absorptivity @ 226 nm of less than 0.11 l/g-cm;
absorptivity @ 275 nm of less than 0.011 l/g-cm;
absorptivity @ 302 nm of less than 0.013 l/g-cm;
absorptivity @ 310 nm of less than 0.017 l/g-cm; and
absorptivity @ 325 nm of less than 0.008 l/g-cm.

11. The base stock of clause 9 having an amount and distribution of aromatics, as determined by ultra violet (UV) spectroscopy, comprising:

absorptivity @ 226 nm of less than 0.11 l/g-cm;
absorptivity @ 254 nm of less than 0.008 l/g-cm;
absorptivity @ 275 nm of less than 0.011 l/g-cm;
absorptivity @ 302 nm of less than 0.013 l/g-cm;
absorptivity @ 310 nm of less than 0.017 l/g-cm;
absorptivity @ 325 nm of less than 0.008 l/g-cm;
absorptivity @ 339 nm of less than 0.006 l/g-cm; and
absorptivity @ 400 nm of less than 0.0007 l/g-cm.

12. The base stock of clauses 9-11 wherein the cycloparaffin performance ratio is greater than 1.4.

13. The base stock of clauses 9-12 wherein the saturates comprise monocycloparaffinic species of 0 X-class, and wherein the monocycloparaffinic species are greater than 39 wt. %, based on the total wt. % of all saturates and aromatics.

14. The base stock of clauses 9-12 wherein the saturates comprise cycloparaffinic species and the aromatics comprise naphthenoaromatic species, and wherein the cycloparaffinic species and the naphthenoaromatic species are less than 75 wt. %, based on the total wt. % of all saturates and aromatics.

15. The base stock of clauses 9-12 wherein the saturates comprise cycloparaffinic species and the aromatics comprise naphthenoaromatic species of −2 X-class, and wherein the 2+ ring species of the cycloparaffinic species and the naphthenoaromatic species are less than 39 wt. %, based on the total wt. % of all saturates and aromatics.

16. The base stock of clauses 9-12 wherein the saturates comprise cycloparaffinic species and the aromatics comprise naphthenoaromatic species of −4 X-class, and wherein the 3+ ring species of the cycloparaffinic species and the naphthenoaromatic species are less than 10.8 wt. %, based on the total wt. % of all saturates and aromatics.

17. The base stock of clauses 9-12 wherein the saturates comprise cycloparaffinic species and the aromatics comprise naphthenoaromatic species of −6 X-class, and wherein the 4+ ring species of the cycloparaffinic species and the naphthenoaromatic species are less than 3.2 wt.

%, based on the total wt. % of all saturates and aromatics.

18. A lubricating oil having a composition comprising a base stock of clauses 1-8 as a major component; and one or more additives as a minor component.

19. A lubricating oil having a composition comprising a base stock of clauses 9-17 as a major component; and one or more additives as a minor component.

20. A method for improving oxidation performance of a lubricating oil as measured by a rotating pressure vessel oxidation test (RPVOT) by ASTM D2272, said lubricating oil comprising a base stock of clauses 1-8 as a major component; and one or more additives as a minor component; wherein said method comprises controlling the cycloparaffin performance ratio to achieve a ratio greater than 1.05.

21. A method for improving oxidation performance of a lubricating oil as measured by a rotating pressure vessel oxidation test (RPVOT) by ASTM D2272, said lubricating oil comprising a base stock of clauses 9-17 as a major component; and one or more additives as a minor component; wherein said method comprises controlling the cycloparaffin performance ratio to achieve a ratio greater than 1.05.

22. A method for improving low temperature performance of a lubricating oil as measured by a mini-rotary viscometer (MRV) by ASTM D4684, said lubricating oil comprising a base stock of clauses 1-8 as a major component; and one or more additives as a minor component; wherein said method comprises controlling the cycloparaffin performance ratio to achieve a ratio greater than 1.05; controlling monocycloparaffinic species greater than 44 wt. %, based on the total wt. % of all saturates and aromatics; and/or controlling isoparaffinic species greater than 21 wt. %, based on the total wt. % of all saturates and aromatics.

23. A method for improving low temperature performance of a lubricating oil as measured by a mini-rotary viscometer (MRV) by ASTM D4684, said lubricating oil comprising a base stock of clauses 9-17 as a major component; and one or more additives as a minor component; wherein said method comprises controlling the cycloparaffin performance ratio to achieve a ratio greater than 1.05; controlling monocycloparaffinic species greater than 39 wt. %, based on the total wt. % of all saturates and aromatics; and/or controlling isoparaffinic species greater than 25 wt. %, based on the total wt. % of all saturates and aromatics.

24. A base stock blend comprising from 5 to 95 wt. % of a first base stock of clauses 1-8 and from 5 to 95 wt. % of a second base stock of clauses 9-17.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A base stock comprising:

at least about 90 wt. % saturates, and further comprising aromatics, the base stock having:

an ultra violet (UV) spectroscopy absorptivity between 280 and 320 nm of about 0.015 Vg-cm or less, a UV spectroscopy absorptivity @ 302 nm of about 0.005 Vg-cm or less, a viscosity index (VI) from about 80 to about 120; and a kinematic viscosity at 100° C. of about 4 to less than 6 cSt.

2. The base stock of claim 1 having:

UV spectroscopy absorptivity @ 226 nm of about 0.15 l/g-cm or less;

UV spectroscopy absorptivity @ 275 nm of about 0.013 l/g-cm or less;

UV spectroscopy absorptivity @ 310 nm of about 0.006 l/g-cm or less; and

UV spectroscopy absorptivity @ 325 nm of about 0.0017 l/g-cm or less.

3. The base stock of claim 1 having:

UV spectroscopy absorptivity @ 226 nm of about 0.15 l/g-cm or less;

UV spectroscopy absorptivity @ 254 nm of about 0.007 l/g-cm or less;

UV spectroscopy absorptivity @ 275 nm of about 0.013 l/g-cm or less;

UV spectroscopy absorptivity @ 310 nm of about 0.006 l/g-cm or less;

UV spectroscopy absorptivity @ 325 nm of about 0.0017 l/g-cm or less;

UV spectroscopy absorptivity @ 339 nm of less-then about 0.0013 l/g-cm or less; and UV spectroscopy absorptivity @ 400 nm of about 0.00014 l/g-cm or less.

4. The base stock of claim 1 wherein the saturates comprise monocycloparaffinic species of 0 X-class, and wherein the monocycloparaffinic species are about 41 wt. % or greater, based on the total wt. % of all saturates and aromatics.

5. The base stock of claim 1 wherein the saturates comprise cycloparaffinic species and the aromatics comprise naphthenoaromatic species of −2 X-class, and wherein the 2+ ring species of the cycloparaffinic species and the naphthenoaromatic species are about 35 wt. % or less, based on the total wt. % of all saturates and aromatics.

6. The base stock of claim 1 wherein the saturates comprise cycloparaffinic species and the aromatics comprise naphthenoaromatic species of −4 X-class, and wherein the 3+ ring species of the cycloparaffinic species and the naphthenoaromatic species are about 11 wt. % or less, based on the total wt. % of all saturates and aromatics.

7. The base stock of claim 1 wherein the saturates comprise cycloparaffinic species and the aromatics comprise naphthenoaromatic species of −6 X-class, and wherein the 4+ ring species of the cycloparaffinic species and the naphthenoaromatic species are about 3.7 wt. % or less, based on the total wt. % of all saturates and aromatics.

8. The base stock of claim 1 wherein the saturates comprise monomethyl paraffinic species, and wherein the monomethyl paraffinic species are about 1 wt. % or less, based on the total wt. % of all saturates and aromatics.

9. The base stock of claim 1 wherein the saturates comprise branched iso-paraffinic species and wherein the branched iso-paraffinic species have greater than 1 tertiary or pendant propyl groups per 100 carbon atoms.

10. The base stock of claim 1 produced from a mixed feed comprising a vacuum gas oil feed and a hydrotreated coker gas oil feed.

11. The base stock of claim 1 wherein the kinematic viscosity at 100° C. is between about 5 and less than 6 cSt.

12. The base stock of claim 1 wherein the weight % saturates is greater than 98.

13. The base stock of claim 1 wherein the viscosity index (VI) is greater than 105.

14. The base stock of claim 1 having a pour point about −12° C. or less.

15. A lubricating oil having a composition comprising a base stock as a major component; and one or more additives as a minor component, wherein the base stock comprises:

at least about 90 wt. % saturates, and further comprises aromatics, the base stock having:

an ultra violet (UV) spectroscopy absorptivity between 280 and 320 nm of less than 0.015 Vg-cm, a viscosity index (VI) from about 80 to about 120; and a kinematic viscosity at 100° C. of about 4 to less than 6 cSt.

16. The lubricating oil of claim 15 the base stock having:

UV spectroscopy absorptivity @ 226 nm of about 0.15 l/g-cm or less;

UV spectroscopy absorptivity @ 275 nm of about 0.013 l/g-cm or less;

UV spectroscopy absorptivity @ 302 nm of about 0.005 l/g-cm or less;

UV spectroscopy absorptivity @ 310 nm of about 0.006 l/g-cm or less; and

UV spectroscopy absorptivity @ 325 nm of about 0.0017 l/g-cm or less.

17. The lubricating oil of claim 15 wherein the base stock has an amount and distribution of aromatics, as determined by ultra violet (UV) spectroscopy, comprising:

UV spectroscopy absorptivity @ 226 nm of about 0.15 l/g-cm or less;

UV spectroscopy absorptivity @ 254 nm of about 0.007 l/g-cm or less;

UV spectroscopy absorptivity @ 275 nm of about 0.013 l/g-cm or less;

UV spectroscopy absorptivity @ 302 nm of about 0.005 l/g-cm or less;

UV spectroscopy absorptivity @ 310 nm of about 0.006 l/g-cm or less;

UV spectroscopy absorptivity @ 325 nm of about 0.0017 l/g-cm or less;

UV spectroscopy absorptivity @ 339 nm of about 0.0013 l/g-cm or less; and

UV spectroscopy absorptivity @ 400 nm of about 0.00014 l/g-cm or less.

18. The lubricating oil of claim 15 wherein, in the base stock, the saturates comprise monocycloparaffinic species of 0 X-class, and wherein the monocycloparaffinic species are about 41 wt. % or greater, based on the total wt. % of all saturates and aromatics.

19. The lubricating oil of claim 15 wherein, in the base stock, the saturates comprise cycloparaffinic species and the aromatics comprise naphthenoaromatic species of −2 X-class, and wherein the 2+ ring species of the cycloparaffinic species and the naphthenoaromatic species are about 35 wt. % or less, based on the total wt. % of all saturates and aromatics.

20. The lubricating oil of claim 15 wherein, in the base stock, the saturates comprise cycloparaffinic species and the aromatics comprise naphthenoaromatic species of −4 X-class, and wherein the 3+ ring species of the cycloparaffinic species and the naphthenoaromatic species are about 11 wt. % or less, based on the total wt. % of all saturates and aromatics.

21. The lubricating oil of claim 15 wherein, in the base stock, the saturates comprise cycloparaffinic species and the aromatics comprise naphthenoaromatic species of −6 X-class, and wherein the 4+ ring species of the cycloparaffinic species and the naphthenoaromatic species are about 3.7 wt. % or less, based on the total wt. % of all saturates and aromatics.

22. The lubricating oil of claim 15 wherein, in the base stock, the saturates comprise monomethyl paraffinic species, and wherein the monomethyl paraffinic species are about 1.0 wt. % or less, based on the total wt. % of all saturates and aromatics.

23. The lubricating oil of claim 15 wherein, in the base stock, the saturates comprise branched iso-paraffinic species, and wherein the branched iso-paraffinic species have greater than 1.2 tertiary or pendant propyl groups per 100 carbon atoms.

24. The lubricating oil of claim 15 wherein the one or more additives comprise one or more of an antiwear additive, viscosity modifier, antioxidant, detergent, dispersant, pour point depressant, corrosion inhibitor, metal deactivator, seal compatibility additive, demulsifying agent, anti-foam agent, inhibitor, and anti-rust additive.

25. The lubricating oil of claim 15 having improved oxidation performance, as measured by a rotating pressure oxidation test (RPVOT) by ASTM D2272, as compared to oxidation performance of a lubricating oil containing a base stock other than said base stock, and having a similar saturates content.

26. The lubricating oil of claim 15 having improved low temperature performance of about 2000 cP or more, as measured by a mini-rotary viscometer (MRV) by ASTM D4684, as compared to low temperature performance of a lubricating oil containing a base stock other than said base stock, and having a similar pour point.

27. The lubricating oil of claim 15 wherein the base stock is produced from a mixed feed comprising a vacuum gas oil feed and a hydrotreated coker gas oil feed.

28. The lubricating oil of claim 15 which is a passenger vehicle engine oil (PVEO).

29. The lubricating oil of claim 15 wherein the base stock has a kinematic viscosity at 100° C. between about 5 and less than 6 cSt.

30. The lubricating oil of claim 15 wherein the base stock has a weight % saturates of greater than 98.

31. The lubricating oil of claim 15 wherein the base stock has a viscosity index (VI) of greater than 105.

32. The lubricating oil of claim 15 wherein the base stock has a pour point of about −12° C. or less.

33. A method for improving oxidation performance of a lubricating oil as measured by a rotating pressure vessel oxidation test (RPVOT) by ASTM D2272, the method comprising:

providing a feed comprising a vacuum gas oil feed having a solvent dewaxed oil feed viscosity index of 20 to 45, forming a base stock from the feed, the base stock comprising at least about 90 wt. % saturates and further comprising aromatics, the base stock having:

a kinematic viscosity at 100° C. of about 4 to less than 6 cSt, an ultra violet (UV) spectroscopy absorptivity between 280 and 320 nm of about 0.015 l/gm-cm or less, a viscosity index (VI) from about 80 to about 120; and forming the lubricating oil from the base stock as a major component and one or more additives as a minor component.

34. The method of claim 33 wherein the base stock is produced from a mixed feed comprising the vacuum gas oil feed and a hydrotreated coker gas oil feed.

35. The method of claim 33 wherein the base stock has a kinematic viscosity at 100° C. between about 5 and less than 6 cSt.

36. The method of claim 33 wherein the base stock has a weight % saturates of greater than 98.

37. The method of claim 33 wherein the base stock has a viscosity index (VI) of greater than 105.

38. A method for improving low temperature performance of a lubricating oil as measured by a mini-rotary viscometer (MRV) by ASTM D4684, the method comprising:

providing a feed comprising a vacuum gas oil feed having a solvent dewaxed oil feed viscosity index of 20 to 45, forming a base stock from the feed, the base stock comprises saturates in an amount of 90 wt. % or greater, and further comprises aromatics, the base stock having:

a kinematic viscosity at 100° C. of about 4 to less than 6 cSt, an ultra violet (UV) spectroscopy absorptivity between 280 and 320 nm of about 0.015 l/gm-cm or less, a viscosity index (VI) from about 80 to about 120, controlling the amount of monocycloparaffinic species in the base stock to about 44 wt. % or greater, based on the total wt. % of all saturates and aromatics, and/or controlling the amount of iso-paraffinic species to about 21 wt. % or greater, based on the total wt. % of all saturates and aromatics; and forming the lubricating oil from the base stock as a major component and one or more additives as a minor component.

39. The method of claim 38 wherein the base stock is produced from a mixed feed comprising the vacuum gas oil feed and a hydrotreated coker gas oil feed.

40. The method of claim 38 wherein the base stock has a kinematic viscosity at 100° C. between about 5 and less than 6 cSt.

41. The method of claim 38 wherein the base stock has a weight % saturates of greater than 98.

42. The method of claim 38 wherein the base stock has a viscosity index (VI) of greater than 105.

* * * * *